United States Patent [19]

Koyama et al.

[11] Patent Number: 4,594,870

[45] Date of Patent: Jun. 17, 1986

[54] AUTOMATIC BENDING APPARATUS

[75] Inventors: Hideo Koyama; Takeshi Hoh; Fumio Noguchi; Yoshiaki Nobuhara, all of Hyogo, Japan

[73] Assignee: Shin-Meiwa Industry Co., Ltd., Japan

[21] Appl. No.: 552,423

[22] Filed: Nov. 16, 1983

[30] Foreign Application Priority Data

| | | | |
|---|---|---|---|
| Nov. 25, 1982 | [JP] | Japan | 57-207927 |
| Jul. 25, 1983 | [JP] | Japan | 58-136645 |
| Aug. 31, 1983 | [JP] | Japan | 58-161611 |

[51] Int. Cl.[4] ..... B21D 43/11; B21D 5/02

[52] U.S. Cl. ..... 72/24; 72/389; 72/422

[58] Field of Search ..... 72/7, 30, 24, 34, 389, 72/422

[56] References Cited

U.S. PATENT DOCUMENTS

| | | | |
|---|---|---|---|
| 3,146,819 | 9/1964 | Van Endert | 72/389 |
| 3,855,840 | 12/1974 | Kawano | 72/389 |
| 4,242,898 | 1/1981 | Salvagnini | 72/384 |
| 4,430,879 | 1/1984 | Rolland | 72/389 |

FOREIGN PATENT DOCUMENTS

| | | | |
|---|---|---|---|
| 551937 | 6/1978 | Japan | 72/422 |
| 58283 | 10/1979 | Japan | 72/422 |
| 68127 | 5/1980 | Japan | 72/422 |
| 209721 | 6/1981 | Japan | 72/422 |
| 1358832 | 7/1974 | United Kingdom | 72/420 |

*Primary Examiner*—Francis S. Husar
*Assistant Examiner*—Jerry Kearns
*Attorney, Agent, or Firm*—Darby & Darby

[57] ABSTRACT

An automatic bending apparatus comprises a bending machine (1) provided with a bottom die (*7a*) and a top die (*7b*) for bending a plate, and a gripper (27) for holding the plate. The gripper (27) can be positioned in a vertical plane in the forward and backward direction with respect to the bending machine (1) as well as around a horizontal axis orthogonally intersecting with the vertical plane. When the plate is bent by lowering of the top die (*7b*) or lifting of the bottom die (7a), the ends of the plate rise. In order to make the gripper (27) follow up the rising motion, positioning of the gripper (27) is controlled successively based on the position data concerning the lowering of the top die (*7b*) or the lifting of the bottom die (*7a*).

13 Claims, 60 Drawing Figures

329

P-Q TABLE

| | FLAG | PREDETERMINED POINT Q | BENDING POINT P |
|---|---|---|---|
| $P_1$ | -1 | ( $x_1$ , $z_1$ ) | ( $x_1$ , $z_1$ ) |
| $P_2$ | 0 | | ( $x_2$ , $z_2$ ) |
| $P_3$ | 0 | | ( $x_3$ , $z_3$ ) |
| $P_4$ | 0 | | ( $x_4$ , $z_4$ ) |
| $P_5$ | 0 | | ( $x_5$ , $z_5$ ) |
| $P_6$ | 0 | | ( $x_6$ , $z_6$ ) |
| $P_e$ | -1 | ( $x_e$ , $z_e$ ) | ( $x_e$ , $z_e$ ) |

FORWARD

BACKWARD

AUTOMATIC BENDING APPARATUS

BACKGROUND OF THE INVENTION

1. Field of the Invention

The present invention relates to an automatic bending apparatus and more particularly, to an automatic bending apparatus having a wide universality in which a plate such as an iron plate is supplied to a press brake type bending machine whereby the plate is bent and then taken out.

2. Description of the Prior Art

Conventionally, bending of plates such as iron plates etc. was performed using a press brake type bending machine or the like controlled by operators. Accordingly, such a bending operation was made extremely inefficiently and needed many operators.

Therefore, the applicant of the present invention proposed previously automatic bending apparatus comprising a robot working in association with a press brake type bending machine so that bending of a plate can be automatically performed. Such proposed automatic bending apparatus are disclosed, for example, in Japanese Patent Laying-Open Gazette No. 130463/1979 laid open on Oct. 9, 1979, Japanese Patent Laying-Open Gazette No. 48425/1980 laid open on Apr. 7, 1980, Japanese Patent Laying-Open Gazette No. 54215/1980 laid open on Apr. 21, 1980 and Japanese Patent Laying-Open Gazette No. 39121/1980 laid open on Oct. 30, 1980, etc. Particularly in Japanese Laying-Open Gazette No. 39121/1980, control of a robot is disclosed in a concrete manner.

In any of the above mentioned conventional automatic bending apparatus, a work piece or a plate is positioned with respect to a bending machine by holding the plate by means of a gripper. However, an end portion of a plate in the horizontal state often rises as a top die is lowered and accordingly, bending operation cannot be made in the state in which the plate is held by the gripper. Although for such automatic bending apparatus, there is also a type in which a bottom die is lifted, the same problem as described above is also involved in this type.

In order to dissolve the above described problem, conventionally a method is adopted in which a plate is first positioned and is held by a gripper until a top die comes in contact with the plate and then the gripper is detached and the top die is further lowered to bend the plate. Then, according to this method, the bent plate is appropriately held again by the gripper and the top die is lifted and subsequently, the plate is further positioned by the gripper for another bending process or released when the bending process is completed. In such a conventional method, it becomes necessary to set free the plate from the state held by the gripper or to shift the grasp by the gripper from one position to another on the plate. However, in certain kinds of plates, plastic deformation or deflection would be caused during bending operation and accordingly, the position to be newly grasped by the gripper would become unclear and deviate from the initially grasped position. It follows that a product in a shape erroneously bent is obtained. Therefore, it is preferable not to remove the gripper from the work piece or not to shift the hold by the gripper from one position to another during the bending process as far as possible.

SUMMARY OF THE INVENTION

Briefly state, the present invention is an automatic bending apparatus comprising:

a bending machine provided with a bottom die and a top die for pressing a plate interposed therebetween so as to bend it into a predetermined form, a gripper disposed at least in front of the above described bending machine so as to hold the above described plate, the gripper being able to be positioned in a vertical plane in the forward and backward direction with respect to the bending machine as well as around a horizontal axis orthogonally intersecting with the vertical plane and a portion of the plate grasped by the gripper being displaced according to the above described bending operation, means for calculating a follow-up position of the above described gripper according to the above described displacement of the plate, and means for controlling positioning of the gripper based on the result of the above described calculation.

According to the present invention, a gripper is made to follow up the rising motion of a plate caused during the bending operation. Accordingly, bending operation of a plate can be performed with a gripper continuously holding the plate.

In a preferred embodiment of the present invention, positioning of at least either a top die or a bottom die is controlled successively in response to position instructions given by successive calculation in a first calculating means and a follow-up position is calculated successively in a second calculating means in order to make the gripper follow up the displacement of the plate caused by bending, whereby position control of the gripper is made according to the follow-up position thus calculated. Furthermore, in this embodiment, the above described second calculating means calculates, with moving velocity of the gripper as a parameter, an element for correction of a delay of response in the gripper positioning control means with respect to position instructions and establishes the position instructions to the gripper, taking account of this element for correction.

In another preferred embodiment of the present invention, each time a plate is bent, position data of each bending point in the plate and position data of a predetermined point having a predetermined relation with each bending point concerned are calculated and stored in a memory and at the time of removing the plate, a moving mechanism is controlled to make each predetermined point stored as described above successively pass through the reference points fixed in advance, whereby the plate is removed from the position between the top die and the bottom die.

Therefore, a primary object of the present invention is to provide an automatic bending apparatus improved so as to be capable of performing bending operation with a gripper continuously holding a plate.

A feature of the present invention resides in that control is facilitated and bending of a plate can be made with an extremely high accuracy, since a gripper continuously holds a determined position of a plate during the bending operation and needs not be detached from the plate nor change the holding position.

Another feature of the present invention resides in that a top die or bottom die and a gipper move smoothly since a delay of response to the position instructions can be corrected. Accordingly, application of overload to the bending machine or to the plate can be prevented and deformation of the work piece and the bending machine which otherwise will be caused can be avoided.

A further feature of the present invention resides in that a plate can be removed from the position between a top die and a bottom die or can be inserted therebetween without interfering with the bending machine.

These objects and other objects, features, aspects and advantages of the present invention will become more apparent from the following detailed description of the present invention when taken in conjunction with the accompanying drawings.

BRIEF DESCRIPTION OF THE DRAWINGS

FIG. 3 shows a partial sectional front view of a gripper and FIG. 4 shows a partial sectional plan view thereof;

DESCRIPTION OF THE PREFERRED EMBODIMENTS

Embodiment in which a top die is lifted and lowered

First, an embodiment in which a top die is lifted and lowered will be described.

Figure 1:
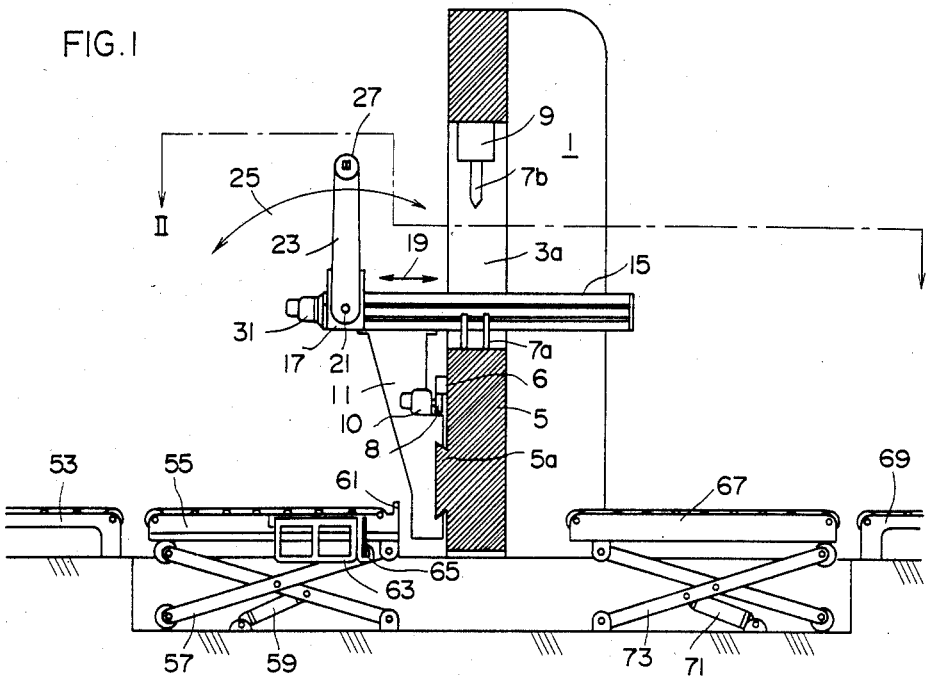
FIG. 1 is a partial sectional side view showing an embodiment of the present invention.
Figure 2:
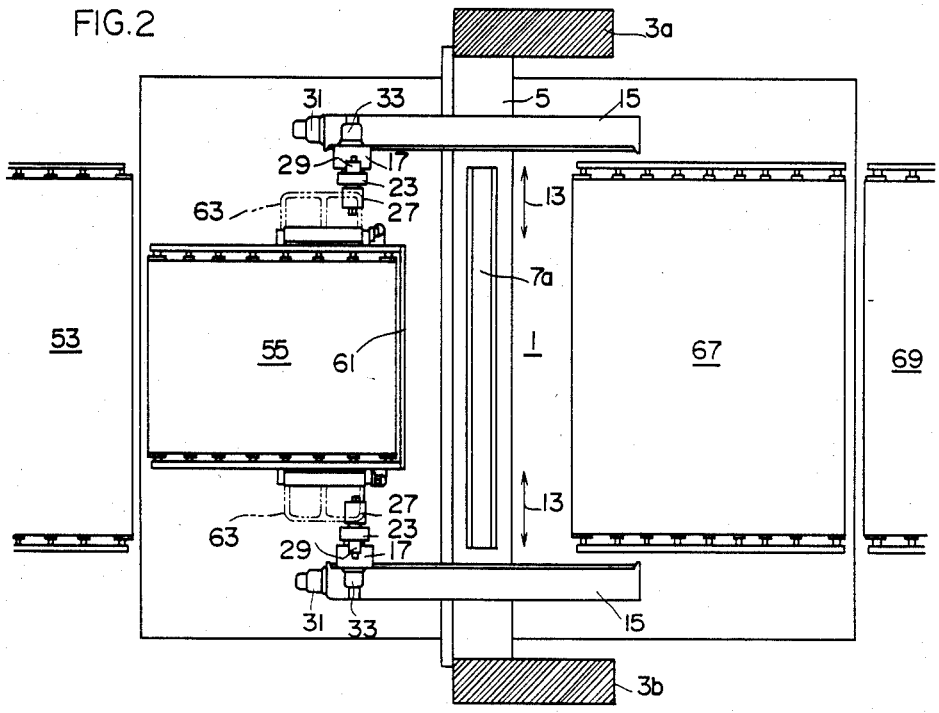
FIG. 2 is a plan view taken along the line II—II in FIG. 1.

FIG. 1 is a partial sectional side view showing a mechanical structure of an embodiment of the present invention. FIG. 2 is a plan view taken along the line II—II in FIG. 1. Referring to FIGS. 1 and 2, description will be made of the structure of this embodiment. A press brake type bending machine 1 includes columns 3*a* and 3*b* in its both ends in the transversal direction. These columns 3*a* and 3*b* are combined by means of a bed 5. On the bed 5, a bottom die 7*a* is provided such that a groove thereof is directed upward. A top die 7*b* having an edge opposed to the groove of the bottom die 7*a* is fixed to a ram 9. Lifting and lowering of the ram 9 are controlled by a control device, not shown, so that lifting and lowering of the top die 7*b* are controlled. As to the bottom die 7*a* and the top die 7*b*, a plurality of bottom dies and top dies having different forms of grooves and edges, respectively, may be provided so that an arbitrary bottom die and an arbitrary top die can be selected according to the necessities.

In the front end surface of the press brake type bending machine 1 (in the left side surface in FIG. 1), an engaging convexity 5*a* is formed so as to extend in the transversal direction of the bed 5. The engaging convexity 5*a* is engaged with an engaging concavity formed in a robot sliding table 11. Accordingly, the robot sliding table 11 is movable in the transversal direction (the direction shown by the arrow 13 in FIG. 2) with respect to the bending machine 1. More specifically, a rack extending in the transversal direction of the bending machine 1 is formed in the front end surface of the bed 5 and a pinion 8 engaged with this rack 6 is provided in the robot sliding table 11, the pinion 8 being connected with an oil hydraulic motor 10. Consequently, by rotating the oil hydraulic motor 10, the pinion 8 is rotated so that the robot sliding table 11 can move along the bed 5 in the direction shown by the arrow 13. In the upper end of the robot sliding table 11, a guide 15 is horizontally supported such that it extends over the bed 5 of the bending machine 1 toward the rear of the bending machine 1. In the guide 15, an arm holder or a sliding member 17 is supported to be movable in the forward and backward directions of the bending machine 1, that is, in the direction shown by the arrow 19 in FIG. 1. In the sliding member 17, one end of an arm 23 is supported by means of an axis 21. Accordingly, this arm 23 is rotatable in the direction shown by the arrow 25 in FIG. 1 with the axis 21 as a center. A gripper 27 is provided in the other end of the arm 23. The gripper 27 is rotated by an oil hydraulic motor 29. The movement of the sliding member or arm holder 17 and the rotation of the arm 23 are controlled by the oil hydraulic motor 31 and the oil hydraulic motor 33, respectively.

Now, referring to FIGS. 3 and 4, a gripper will be described in detail. A fixed claw 27a and a movable claw 27*b* which constitute a gripper 27 are housed in a box 37 fixed to an axis 35 of an oil hydraulic motor 29. This box 37 has an opening 37*a* through which the ends of the two claws 27*a* and 27*b* are projected outside. In the box 37, a guide 39 is provided and a slider 41 is supported by the guide 39 so as to be movable in the longitudinal direction. The slider 41 has one end connected to an actuator 43 fixed to the front inner wall of the box 37 and the fixed claw 27*a* is fixed on this slider 41. On the upper end surface of the fixed claw 27*a*, an axis 45 supporting the movable claw 27*b* in a rotatable manner is provided. An actuator 47 has one end connected to the lower end of the fixed claw 27*a* and the other end connected to the rear end of the movable claw 27*b*. By operation of the actuator 43, the fixed claw 27*a* and the movable claw 27*b*, that is, the gripper 27 can move inward and outward in the direction shown by the arrow 49 through an opening 37*a* of the box 37. By operation of the actuator 47, the movable claw 27*b* can rotate in the direction shown by the arrow 51, so that the opening angle with respect to the fixed claw 27*a* can be controlled.

Figure 5:
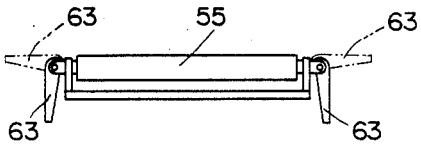
FIG. 5 is a view explaining the operation of a supporter provided in a waiting conveyor.
Figure 6:
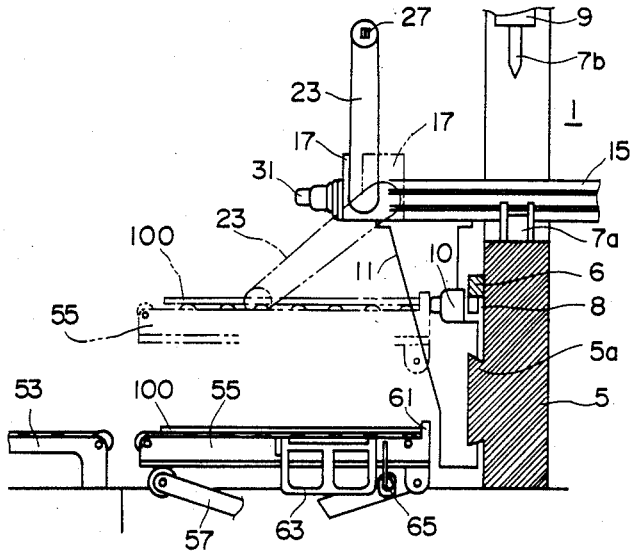
FIGS. 6, 7 and 8 are views for explaining the operation for holding a work piece by a gripper in the embodiment shown in FIG. 1.

Referring again to FIGS. 1 and 2, a carrying conveyor 53 and a waiting conveyor 55 are provided in front of the press brake type bending machine 1. The carrying conveyor 53 carries a plate to the waiting conveyor 55. The waiting conveyor 55 is supported by a pantagraph 57, which is contracted and extended by means of an actuator 59. One end of the waiting conveyor 55 includes a stopper 61 with which the plate to be positioned is brought into contact. Both sides of the upper end of the waiting conveyor 55 are provided with supporters 63 for supporting the portions of the plate which protrude from the conveyor 55. Each supporter 63 is usually in the position shown by the solid lines in FIGS. 1 and 5 but is made to open, if necessary, by the actuator 65 to the position shown by the chained lines in FIGS. 2 and 5.

In the example shown in FIGS. 1 and 2, a discharging conveyor 67 and a transferring conveyor 69 are provided in the rear of the press brake type bending machine 1. The discharging conveyor 67 is supported by a pantagraph 73 contracted and extended by means of an actuator 71, in the same manner as in the waiting conveyor 55.

Figure 7:
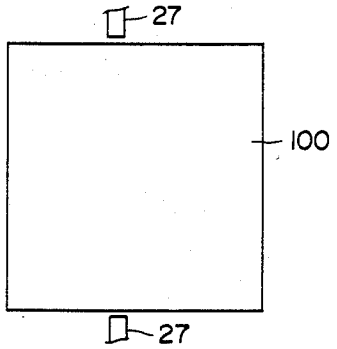
Figure 8:
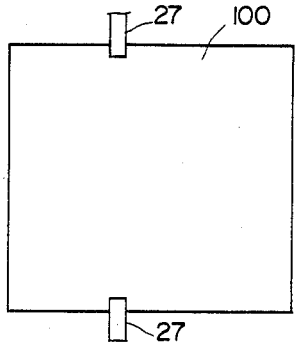

Now, referring to FIGS. 6 to 10, an outline of the sequence of bending operations by the automatic bending apparatus will be described. First, a plate or work piece 100 is carried by the carrying conveyor 53 onto the waiting conveyor 55 and is transported by the conveyor 55 so as to be in contact with the stopper 61. As a result, the work piece or plate 100 is positioned and maintained on the waiting conveyor 55. By operation of the actuator 59 (shown in FIG. 1), the pantagraph 57 is extended. Consequently, the waiting conveyor 55 rises as shown by hydraulic motor 33 (in FIG. 2), the arm 23 is rotated so that the gripper provided in the top thereof can take hold of the work piece 100 on the waiting conveyor 55, which rises as shown by the chained lines in FIG. 6. By controlling the oil hydraulic motor 31 if necessary, the arm holder or sliding member 17 is made to move on the guide 15 so that the position of the gripper 27 with respect to the work piece or plate 100 is controlled. This state is shown in FIG. 7. After that, the actuator 43 (shown in FIG. 3) and also the actuator 47 are made to operate so that a predetermined position of the work piece 100 is grasped by the gripper 27 (as shown in FIG. 8).

Figure 9:
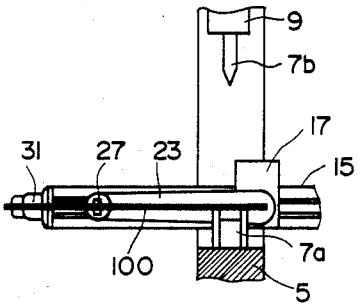
FIG. 9 shows a state in which a work piece is positioned.

In this state, as shown in FIG. 9, the work piece 100 is positioned with respect to the bottom die 7*a* and the top die 7*b* of the bending machine 1. More specifically, by operation of the oil hydraulic motor 33 (in FIG. 2), the work piece 100 is put on the bottom die 7*a* and the arm 23 is positioned so that the work piece 100 is horizontal. At the same time, by controlling the oil hydraulic motor 31, the arm holder 17 is moved. At this time, rotation of the gripper 27 may be controlled by the operation of the oil hydraulic motor 29 (in FIG. 3), if necessary. Thus, the work piece 100 is positioned with respect to the bottom die 7*a* and the top die 7*b*.

Figure 10:
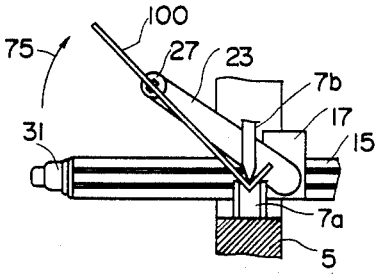
FIG. 10 shows bending operation.

Subsequently, the ram 9 of the bending machine 1 is lowered and the work piece 100 is bent by means of the top die 7*b* and the bottom die 7*a*, as shown in FIG. 10. At this time, an end portion of the work piece 100 rises in the direction shown by the arrow 75 in FIG. 10, as the top die 7*b* is lowered. The feature of the present invention resides in that the gripper 27 follows up such rising of the plate 100 being bent whereby the bending can be performed with the work piece 100 continually held by the gripper 27. All the sequence of bending operations as described above are controlled by a microprocessor or microcomputer.

Figure 11:
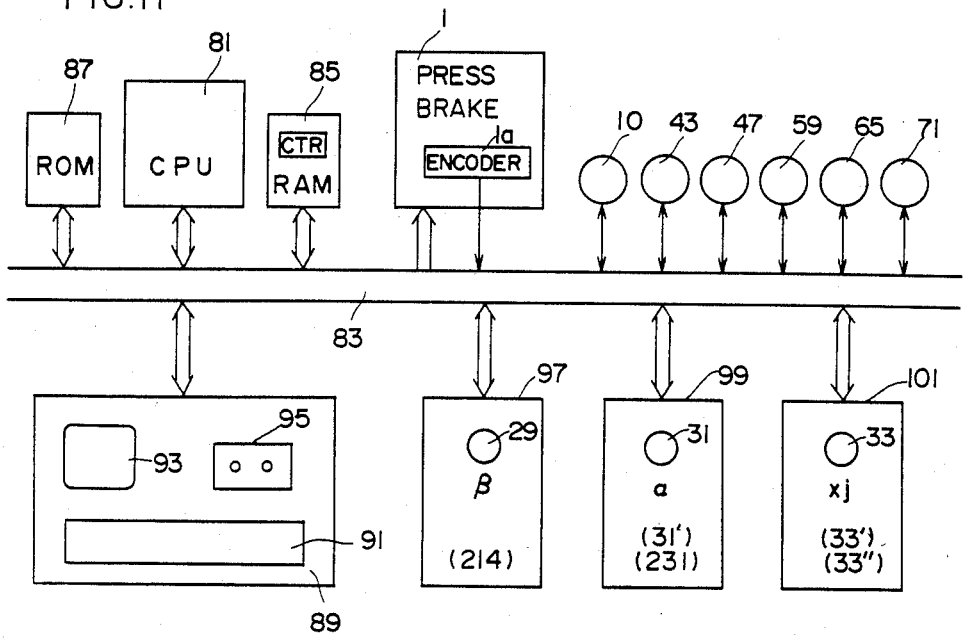
FIG. 11 is a block diagram showing an embodiment of an electric circuit in the present invention.

FIG. 11 is a schematic block diagram showing an electric circuit of an embodiment of the present invention. A central processing unit (CPU) 81 is connected with a random access memory (RAM) 85 and a read-only memory (ROM) 87 through a bus 83. The RAM 85 serves to store the data necessary for calculation or control in the CPU 81 and the ROM 87 serves to program the calculation or control process of the CPU 81 and to store necessary fixed data, for example, data concerning the bending machine 1 or the work piece. The bus 83 is connected with a console 89. The console 89 includes a keyboard 91 and serves to remotely control the press brake type bending machine 1 and the conveyors 55 and 67 etc. or to make teaching operation for automatic bending. The keyboard 91 includes keys of alphabetical and numerical characters and various function keys. The information or data entered by means of such a keyboard 91 is stored in the RAM 85 through the bus 83 and also supplied to the CPU 81. The console 89 includes a display 93 which displays, if necessary, data entered from the keyboard 91 or other necessary information supplied from the CPU 81. The console 89 may contain a cassette deck 95 for utilizing an external memory, for example a magnetic tape. A series of information concerning various kinds of bending operations is stored in the magnetic tape so that necessary data is read out by the cassette deck 95, or necessary data is written in the magnetic tape by means of the cassette deck 95.

The bus 83 connected to the CPU 81 is further connected with the press brake type bending machine 1 so that lifting and lowering of the top die 7*b*, that is, the ram 9 are controlled. The bending machine 1 comprises an encoder 1*a* for providing the information (the height data h to be described below) in accordance with the lifting or lowering of the ram 9. The information from the encoder 1*a* is supplied to the CPU 81 and the RAM 85 through the bus 83. The bus 83 is further connected with the oil hydraulic motor 10 and the actuators 43, 47, 59, 65 and 71 through suitable interfaces respectively. Accordingly, motor 10 and the actuators 43, 47, 59, 65 and 71 are also controlled by the CPU 81.

Positioning apparatus 97, 99 and 101 respectively including oil hydraulic motors 29, 31 and 33 contained in a robot are also connected to the bus 83. The positioning apparatus 97, 99 and 101 control respectively the angle $\beta$, the angle $\alpha$ and the position xj to be described below.

Now, the information for teaching by utilizing the console 89 will be described with reference to an example in FIG. 12. In the example shown in FIG. 12, the points ②, ③, ④ and ⑤ are to be bent respectively. For this purpose, the coordinate postion data of the respective points ② to ⑤ are taught in the X-Z coordinate system. At the same time, for the purpose of positioning, the position data of both end points ① and ⑥ of the work piece 100 are also taught in the coordinate system. In case where a plurality of bending points are given as in this example, the bending order must be taught at the same time. In the example in FIG. 12, the bending order will be set from the bending point ② to the points ③, ⑤ and ④. By means of the console 89, information or data concerning the work piece 100 such as the plate thickness t, the plate width.and the material of the plate (for example, iron, aluminum, etc.) is also entered. The data concerning the plate thickness t is particularly necessary for the control in an embodiment to be described below. Furthermore, if exchange of dies is needed, the data concerning the necessary dies and the order of using them are inputted at first. Then, appropriate dies are automatically selected during the bending operations.

Figure 13:
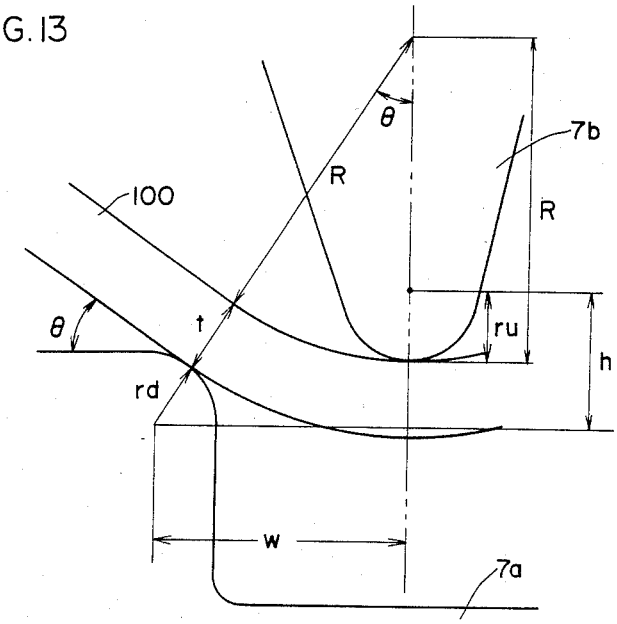
FIG. 13 is a model showing a relation between top and bottom dies and a work piece during the bending operation.

FIG. 13 is a view showing a model of a bending process which constitutes a theoretical basis for the present invention. An end of the top die 7*b* forms a circular arc having a radius (ru). The bottom die 7*a* has a side portion where a groove is formed and this side portion has a top portion in the form of a circular arc having a radius (rd) which is to be in contact with the work piece 100. The distance from the center of curvature of this top portion to the center of the groove is assumed to be (w). It is assumed that the plate thickness of the work piece 100 existing between the bottom die 7*a* and the top die 7*b* is (t) and the work piece 100 is bent in the form of a circular arc having a predetermined radius of curvature (R) in accordance with the lowering of the top die 7*b*. The distance or height between the center of curvature of the end of the top die 7*b* and the center of curvature of the top portion of the bottom die 7*a* is assumed to be (h). The information concerning this height (h) is obtained from the encoder la shown in FIG. 11. As the top die 7*b* is lowered, that is, as the height (h) is decreased, the work piece 100 rises from the horizontal state with a rising angle ($\theta$).

If such a model case as described above is supposed, the following equation (1) is obtained and by transforming the equation (1), the equation (2) is obtained.

$$(R + h - ru)^2 + w^2 = (R + t + rd)^2 \tag{1}$$

$$R^2 + 2R(h - ru) + (h - ru)^2 + w^2 = R^2 + 2R(t + rd) + (t + rd)^2$$

$$\therefore R = \frac{1}{2} \cdot \frac{(h - ru)^2 - (t + rd)^2 + w^2}{t + ru + rd - h} \tag{2}$$

On the other hand, from the following equations (3) and (4) and the equation (2), the rising angle ($\theta$) of the work piece 100 is represented as a function of the height (h) of the top die 7*b*.

$$(R+t+rd) \sin \theta = w \tag{3}$$

$$(R+t+rd) \cos \theta = (R+h-ru) \tag{4}$$

$$\theta = \tan^{-1}\{w/(R + h - ru)\} \tag{5}$$

$$= \tan^{-1} \frac{w}{\left\{ \frac{1}{2} \cdot \frac{(h-ru)^2-(t+rd)^2+w^2}{t+ru+rd-h} \right\} + h - ru}$$

In a preferred embodiment of the present invention, follow-up control of the gripper 27 is made by utilizing the rising angle ($\theta$) in view of the correlation between the rising angle ($\theta$) and the height (h) of the top die as described above. For the purpose of making the follow-up control, the above described equation (5) and the necessary data (ru, t, rd and the like) are stored as a table in the ROM 85 (in FIG. 11), for example.

Figure 14:
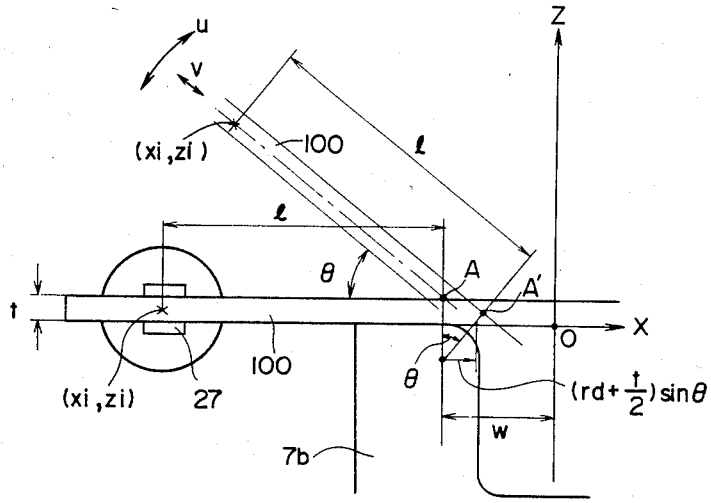
FIG. 14 is a model for calculating a position of a gripper to be controlled.

With reference to FIG. 14, the postion data (xi, zi) for the follow-up control of the gripper 27 will be obtained in the following manner. In FIG. 14, it is assumed that the distance between the center of curvature of the top portion of the bottom die 7*a* and the center of rotation of the gripper 27 is (l). When the work piece 100 is bent with the rising angle ($\theta$), the point A is moved to A', as shown in FIG. 14. From this FIG. 14, the position (xi, zi) of the center of rotation of the gripper 27 is calculated by the equation (6).

$$xi = \left\{ w - \left( rd + \frac{t}{2} \right) \sin\theta \right\} + l\cos\theta \quad (6)$$

$$zi = \left\{ -rd + \left( rd + \frac{t}{2} \right) \cos\theta \right\} + l\sin\theta$$

Figure 12:
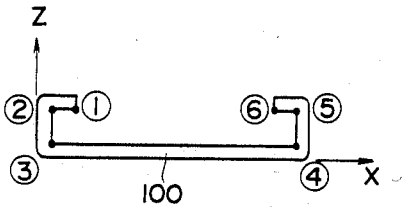
FIG. 12 is a view showing an example of a work piece to be bent.

It is clear that by substituting the equation (5) into this equation (6), the position (xi, zi) can be represented respectively as a function of the height (h) of the top die 7*b* (in FIG. 12).

According to the present invention, the position data of the center of rotation of the gripper 27 as described above are calculated successively according to the change in the height of the top die 7*b* and based on the calculated position data, the angle, the position and other necessary data of control axes are calculated so that oil hydraulic motors 29, 31 and 33, for example, are controlled, whereby bending operations can be performed with the gripper continually holding the work piece.

Figure 15:
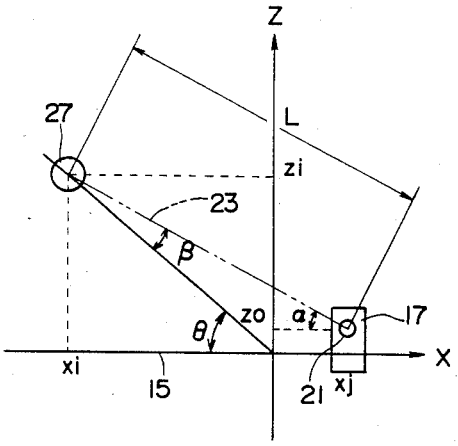
FIG. 15 is a model for obtaining the data necessary for control in the embodiment shown in FIG. 1.

FIG. 15 shows a model illustrating the manner in which the position (xi, zi) of the center of rotation of a gripper is represented in the case of the embodiment shown in FIGS. 1 and 2. Referring to FIG. 15, it is assumed that the length of the arm, that is, the distance from the center of rotation of the arm 23 (in FIG. 1) namely the axis 21 to the center of rotation of the gripper 27 is (L). In order to move the center of the gripper to the position (xi, zi), it is necessary to move the arm holder 17 along the guide 15 (in FIG. 1) and the position of this arm holder or sliding member 17 is assumed to be (xj). The distance between the center of rotation of the arm 23 in the Z axis direction and the origin is assumed to be (zo).

From FIG. 15, the following equation (7) is established and accordingly, it can be seen that the postion (xj) of the arm holder 17 in the axis direction is represented by the equation (8).

$$(xj - xi)^2 + (zi - zo)^2 = L^2 \quad (7)$$

$$xj = \pm\sqrt{L^2 - (zi - zo)^2} + xi \quad (8)$$

From the above described equation (8), two points are given for the position (xj) of the arm holder 17 in the X axis direction, but in this case, either point is selected according to the inclining direction of the arm 23 with respect to the Z axis direction.

In addition, for the purpose of successively controlling the position of the center of rotation of the gripper 27 according to the predetermined position (xi, zi), it is necessary not only to control the position (xj) of the arm holder 17 but also to control the angle ($\alpha$) of the arm 23 and the angle ($\beta$) of the gripper 27 with respect to the arm.

From FIG. 15, these angles ($\alpha$) and ($\beta$) are obtained by the following equations (9) and (10).

$$\tan\alpha = (zi - zo)/(xj - xi)$$
$$\therefore \alpha = \tan^{-1}(zi - zo)/(xj - xi) \quad (9)$$
$$\theta = \tan^{-1} zi/xi$$
$$\therefore \beta = \theta - \alpha$$
$$= (\tan^{-1} zi/xi) - \alpha \quad (10)$$

From the above described equations (8), (9) and (10), it is understood that in order to control the position (xi, zi) of the center of rotation of the gripper 27 following the rising of the work piece, control has only to be made as to the postion (xj) of the arm holder 17, the angle ($\alpha$) of the arm 23 and the angle ($\beta$) of the body of the gripper with respect to the arm. For this data (xj), ($\alpha$) and ($\beta$), control is made by means of the oil hydraulic motors 31, 33 and 29, respectively, in the embodiment shown in FIGS. 1 and 2.

Figure 16A:
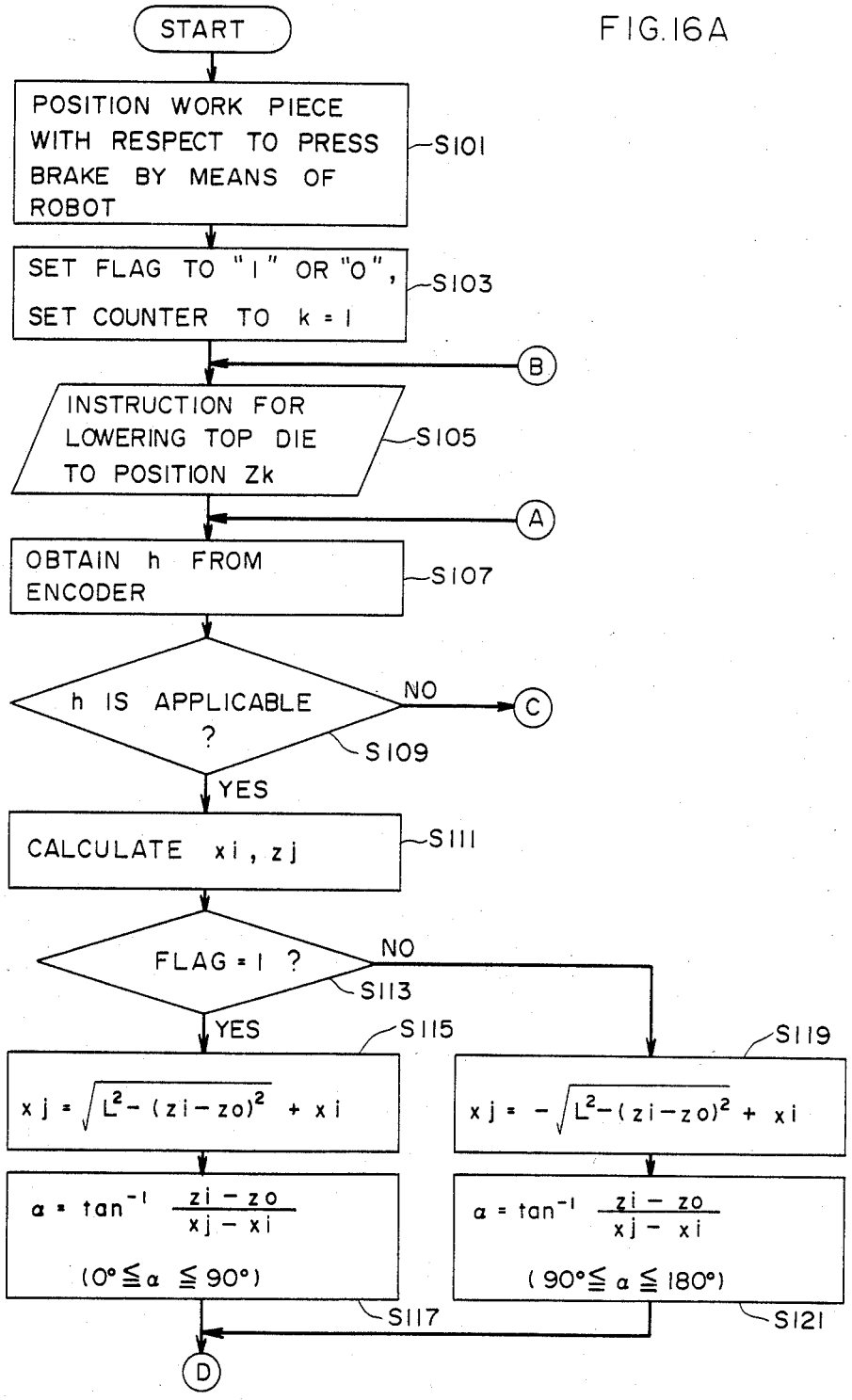
FIGS. 16A and 16B are flow charts for explaining the operation in the embodiment shown in FIG. 1.
Figure 16B:
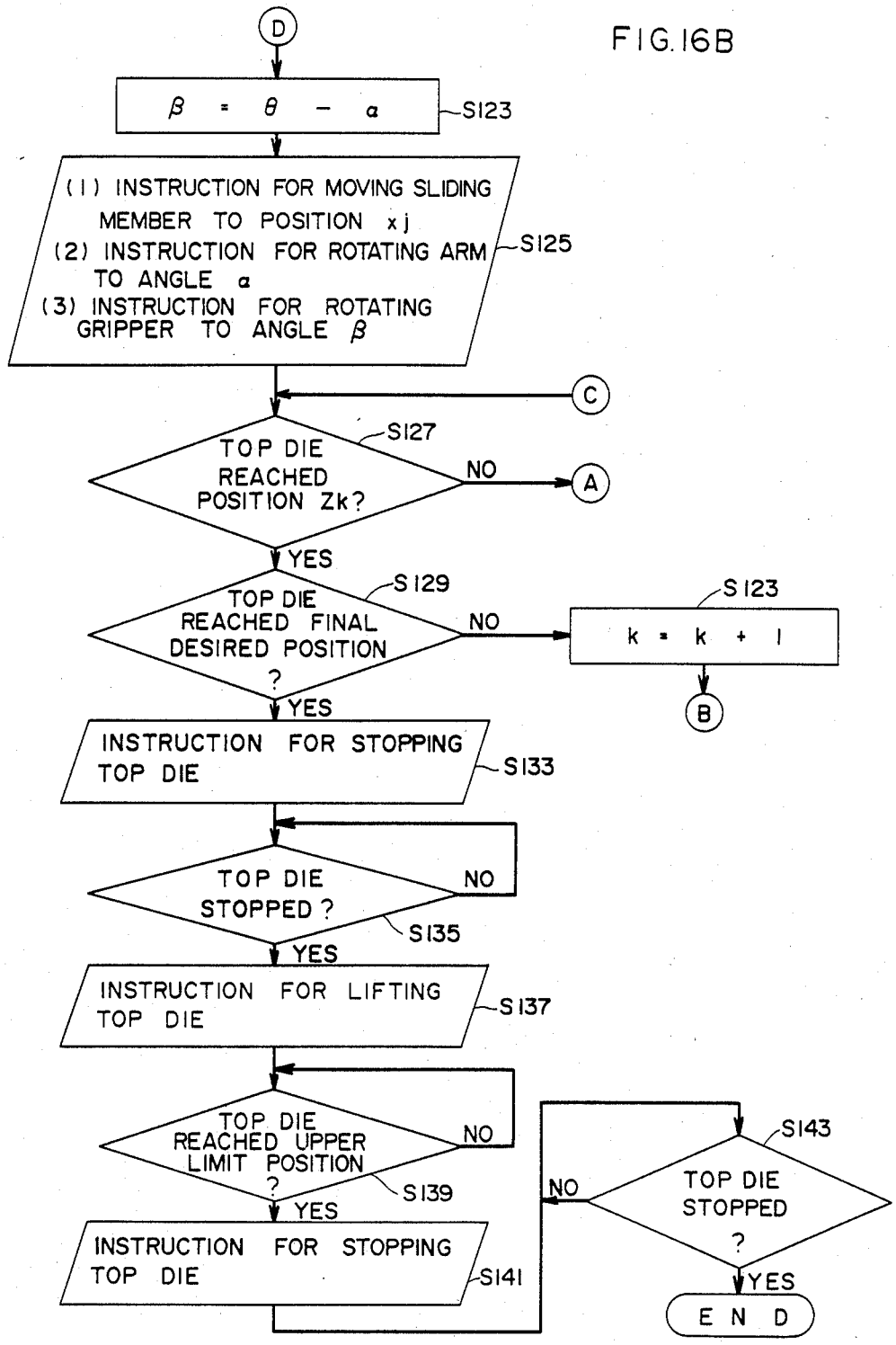

FIGS. 16A and 16B are flow charts for explaining the operation of the embodiment shown in FIGS. 1 and 2, that is, FIG. 14. In the first step S101, the CPU 81 (in FIG. 11) operates to position the work piece with respect to the bending machine (press brake) by means of a robot. This state is shown in FIG. 9. More specifically, the CPU 81 controls the oil hydraulic motors 10, 29, 31 and 33 so as to position the work piece between the bottom die 7*a* and the top die 7*b* based on the data taught concerning the bending points. Subsequently, in the step S103, the CPU 81 determines the contents of the flag and the counter k provided in suitable regions in the RAM 85. The flag is set according to the sign (+) or (−) in the above described equation (8). For example, when positioning is made in the step S101, the flag is set to "1" or "0" depending on the fact that the arm 23 turns clockwise or counterclockwise with respect to the vertical direction (the postion in FIG. 1). The counter k indicates the successive points where the top die 7*b* is to be positioned. The top die 7*b* is successively positioned at every positioning point so as to be lowered finally to the position corresponding to the required bending angle and the like. At first, the counter is set to k=1.

In the subsequent step 105, the CPU 81 gives instructions to the press brake type bending machine 1 through the bus 83 so that the top die 7*b* is lowered to the postion Zk corresponding to the value k determined by the counter. In response, the press brake 1 makes the ram 9 (in FIG. 1) be lowered and accordingly, the top die 7*b* is lowered. At this time, in the step S107, the information corresponding to the height (h) of the top die 7*b* (in FIG. 13) is entered from the encoder 1*a* (in FIG. 11). Then, based on this height (h), it is determined whether the model explained in conjunction with FIG. 14 is applicable or not. Specifically stated, it is determined whether the condition $h \leqq ru+t+rd$ is satisfied or not. If the height (h) is larger than (ru+t+rd), it means that the top die 7*b* is not yet in contact with the work piece 100 and accordingly, since the above described model cannot be applied, the program proceeds directly to the step S127. If the height (h) is in the applicable range, the program proceeds to the subsequent step S111 where the CPU 81 calculates the position (xi, zi) of the center of rotation of the gripper 27 to be followed up, using the above describe equation (6). For this calculation, the rising angle ($\theta$) is applied and the necessary data (ru), (rd), (t) and (w) in the equation (5) for calculating the angle ($\theta$) are respectively programmed in advance in the ROM 87 by means of the console 89. The date (h) is obtained from the encoder la and the data (l) is already known at the time of positioning the work piece in the step S101. In the subsequent step S113, the CPU 81 determines whether the flag is set to "1" or not. This determination is made for the purpose of selecting the sign (+) or (−) in the equation (8).

If the flag is set to "1", the sign (+) is selected in the subsequent steps S115 and S117 so that the values (xj) and ($\alpha$) are calculated using the equations (8) and (9), respectively. If the flag is set to "0", the sign (−) is selected in the steps S119 and S121 so that the values (xj) and ($\alpha$) are calculated using the equations (8) and (9), respectively. Either in case of the flag "1" or in case of the flag "0", after the data (xj) and ($\alpha$) are calculated, the angle ($\beta$) is calculated using the equation (10) in the subsequent step S123. Then, in the subsequent step S125, a driving circuit of a positioning apparatus 99 is instructed to move the position of the arm holder 17 to the position (xj), a driving circuit of a positioning apparatus 101 is instructed to rotate the arm 23 to the angle ($\alpha$) and a driving circuit of a positioning apparatus 97 is instructed to rotate the body of the gripper to the angle ($\beta$). Thus, by making the gripper 27 follow up the points for holding the work piece 100 according to the lowering of the top die *7b*, the work piece can be bent with the gripper 27 continually holding the work piece.

After that, the CPU 81 determines in the step S127 whether the top die *7b* reaches the desired position Zk or not. This determination can be made based on the information from a servo system (not shown) included in the bending machine 1. If the top die *7b* does not reach the position Zk, the program returns to the step S107. In the subsequent step S129, the CPU 81 determines whether the top die *7b* attains the final desired position Z. This determination can be made by examining whether the content k of the counter provided in the RAM 85 attains the number necessary for one bending operation.

If the top die *7b* does not attain the final desired postion Z, the CPU 8 increments the content of the counter k in the RAM 85 in the step S131. Then, the program returns to the step S105.

If the top die *7b* attains the final desired position Z, the CPU 81 gives instructions to the servo system of the press brake 1 in the subsequent step S133 so that the ram 9, that is, the top die *7b* stops lowering. When the stop of the top die *7b* is detected in the step S135, the CPU 81 operates according to the subsequent steps S137, S139, S141 and S143 so that the top die *7b* is returned to the initial position, that is, the home postion. Thus, the follow-up control of the center of rotation of the gripper 27 in the embodiment shown in FIGS. 1 and 2 can be performed.

Figure 17:
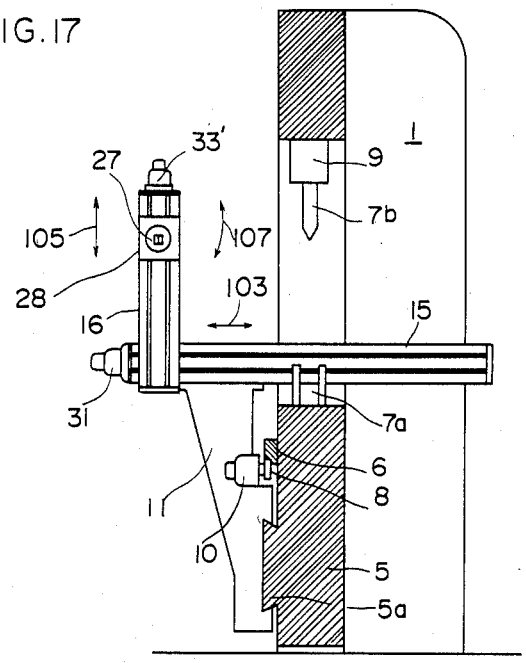
FIG. 17 is an essential part of a partial sectional side view showing another embodiment of the present invention.

FIG. 17 is a view showing an essential part of a partial sectional side view indicating another embodiment of the present invention. This FIG. 17 particularly corresponds to FIG. 1. In this embodiment in FIG. 17, a vertical guide 16 is supported by a guide 15 so as to be movable in the direction shown by the arrow 103 and the vertical guide 16 supports a moving member 28 provided with a gripper 27 so that the moving member 28 is movable in the direction shown by the arrow 105. The gripper 27 provided in the moving member 28 is movable in the direction shown by the arrow 107. The positioning of the vertical guide 16 with respect to the guide 15 is controlled by the oil hydraulic motor 31, the positioning of the moving member 28, that is, the gripper 27 with respect to the guide 16 is controlled by the oil hydraulic motor 33' and the rotation of the gripper 27 is controlled, as in the previously described embodiment, by the oil hydraulic motor 29 (in FIG. 3). In other words, in the FIG. 17 embodiment, the positioning apparatus 97, 99 and 101 shown in FIG. 11 include respectively the oil hydraulic motors 29, 31 and 33'.

Figure 18:
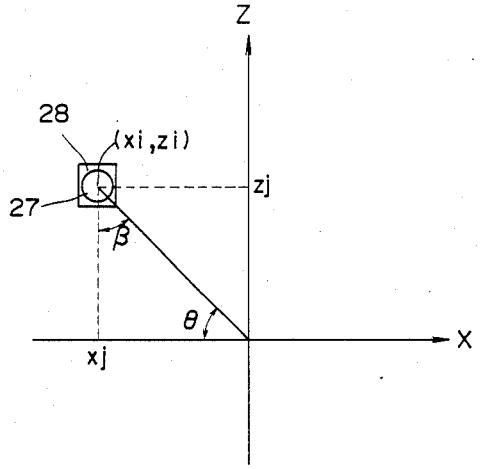
FIG. 18 is a model for obtaining the data necessary for control in the embodiment in FIG. 17.

FIG. 18 represents a model showing the embodiment in FIG. 17 where based on the position (xi, zi) of the center of rotation of the gripper 27 and the rising angle ($\theta$), the position (xj) of the guide 16 with respect to the guide 15, the position (zj) of the gripper 27 with respect to the guide 16 and the rotating angle ($\beta$) of the gripper 27 are respectively, calculated by the following equations (11), (12) and (13).

$$xj = xi \tag{11}$$

$$zj = zi \tag{12}$$

$$\beta = 90 - \theta \tag{13}$$

On the other hand, the postions (xi) and (zi) and the angle ($\theta$) are calculated by the equations (6) and (5) in the same manner as in the previously described embodiment.

Figure 19:
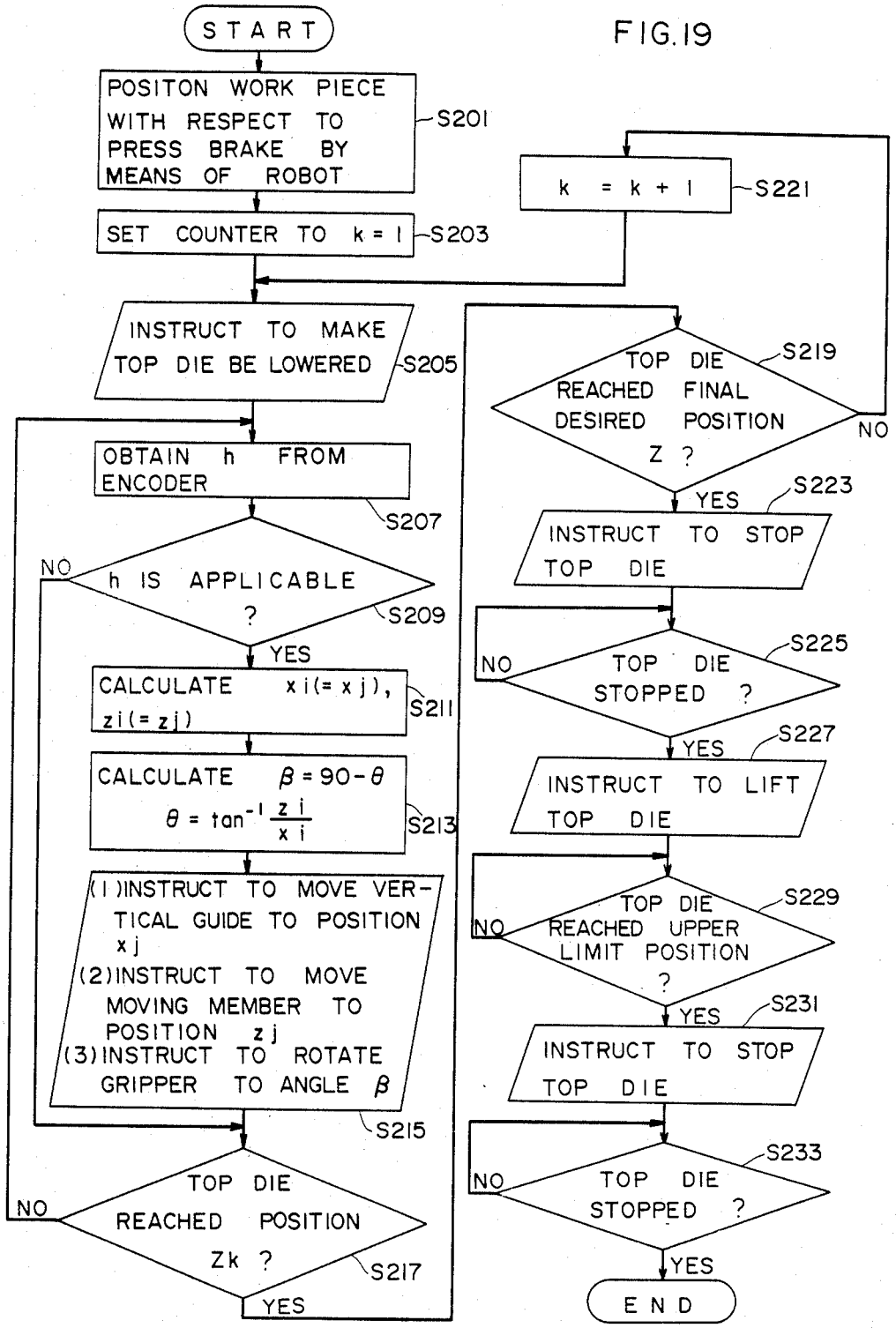
FIG. 19 is a flow chart for explaining the operation in the FIG. 17 embodiment.

FIG. 19 is a flow chart for explaining the controlling operation in the embodiment shown in FIGS. 17 and 18. In the first step S201, the CPU 81 (shown in FIG. 11) controls the oil hydraulic motors 29 (in FIG. 3), 31 and 33' so as to position the work piece (plate) with respect to the press brake by means of a robot. In the subsequent step S203, the counter k of the RAM 85 is set to 1. In the step S205, the CPU 81 gives instructions to the servo system (not shown) included in the bending machine 1 so that the ram 9, that is, the top die *7b* is lowered. The steps S207, S209 and S211 are identical to the previously described steps S107, S109 and S111 in FIG. 16A. In the case of this embodiment, since the vertical guide 16 cannot be rotated in the vertical state, it is not necessary to use a flag. Accordingly, the postion (xi), (zi) obtained in the step S211 becomes directly (xj), (zj). In the subsequent step S213, the CPU 81 makes calculation of the angle ($\beta$) according to the equation (13). In the step S215, the CPU 81 instructs the driving circuit of the positioning apparatus 99 to move the vertical guide 16 to the position (xj), instructs the driving circuit of the positioning apparatus 101 to vertically move the moving member 28 to the position (zj) and instructs the driving circuit of the positioning apparatus 97 to rotate the gripper to the angle ($\beta$).

Thus, also in the embodiment shown in FIG. 17, the holding point of the work piece 100 by the gripper 27 can be followed up according to the rising of the work piece caused by lowering of the top die *7b*. Accordingly, bending operation can be performed with the gripper 27 continually holding the work piece 100.

The steps S217, S219, S221, S223, S225, S227, S229, S231 and S233 in FIG. 19 correspond respectively to the steps S127, S129, S131, S133, S135, S137, S139, S141 and S143 shown in FIG. 16B.

Figure 20:
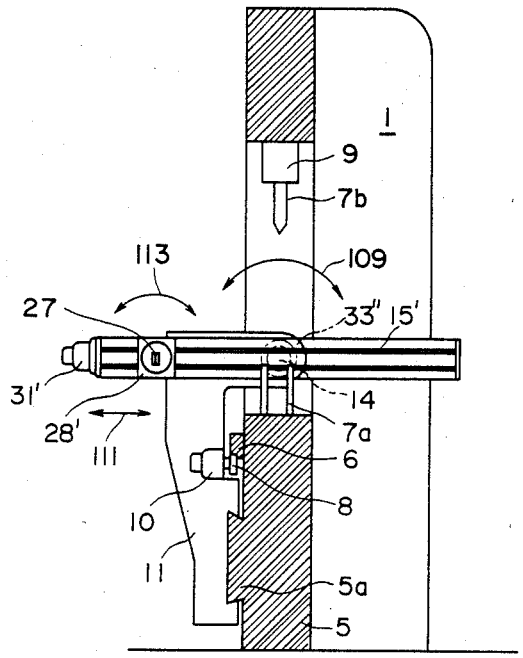
FIG. 20 is an essential part of a partial sectional side view showing a further embodiment of the present invention.

FIG. 20 shows an essential part of a partial sectional side view of a further embodiment of the present invention. In this embodiment, a guide 15' is supported by an axis 14 in a predetermined position over a bed 5 of the bending machine 1 so as to be rotatable in the direction shown by the arrow 109. The axis 14 is provided on the robot sliding table 11. In the guide 15', a moving member 28' is directly supported in a manner movable in the direction shown by the arrow 111. The gripper 27 provided in the moving member 28' is rotatable in the direction shown by the arrow 113. In the embodiment thus structured, the rotation of the guide 15' is controlled by the oil hydraulic motor 33'', the positioning of the moving member 28' with respect to the guide 15' is controlled by the oil hydraulic motor 31' and the rotation of the gripper 27 is controlled by the oil hydraulic motor 29 (in FIG. 3). Accordingly, in the case of this embodiment, the positioning apparatus 97, 99 and 101 shown in FIG. 11 include respectively the oil hydraulic motors 29, 31′ and 33″.

Figure 21:
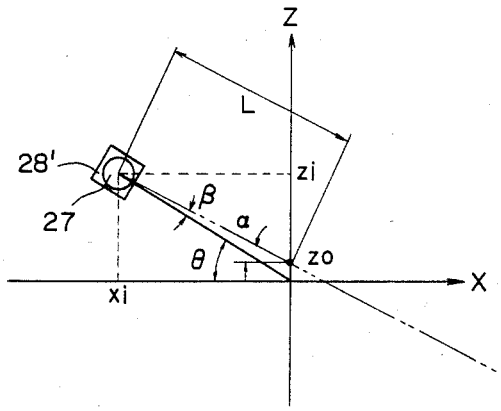
FIG. 21 is a model for obtaining the data necessary for control in the FIG. 20 embodiment.

FIG. 21 shows a model in the embodiment shown in FIG. 20. Referring to FIG. 21, assuming that the distance from the center of rotation of the guide 15′ (that is, the axis 14) to the center of rotation of the gripper 27 is (L), the position of the center of rotation of the guide 15′ in the Z axis direction with respect to the origin is (zo), the angle of the guide 15′ is ($\alpha$) and the angle of the gripper 27 with respect to the moving member 28′ is ($\beta$), the values ($\alpha$), (L) and ($\beta$) are obtained respectively from the equations (14), (15) and (16).

$$\tan \alpha = (zi - zo)/xi$$

$$\therefore \alpha = \tan^{-1}(zi - zo)/xi \quad (14)$$

$$\cos \alpha = xi/L$$

$$\therefore L = xi/\cos \alpha \quad (15)$$

$$\beta = \theta - \alpha \quad (16)$$

Figure 22A:
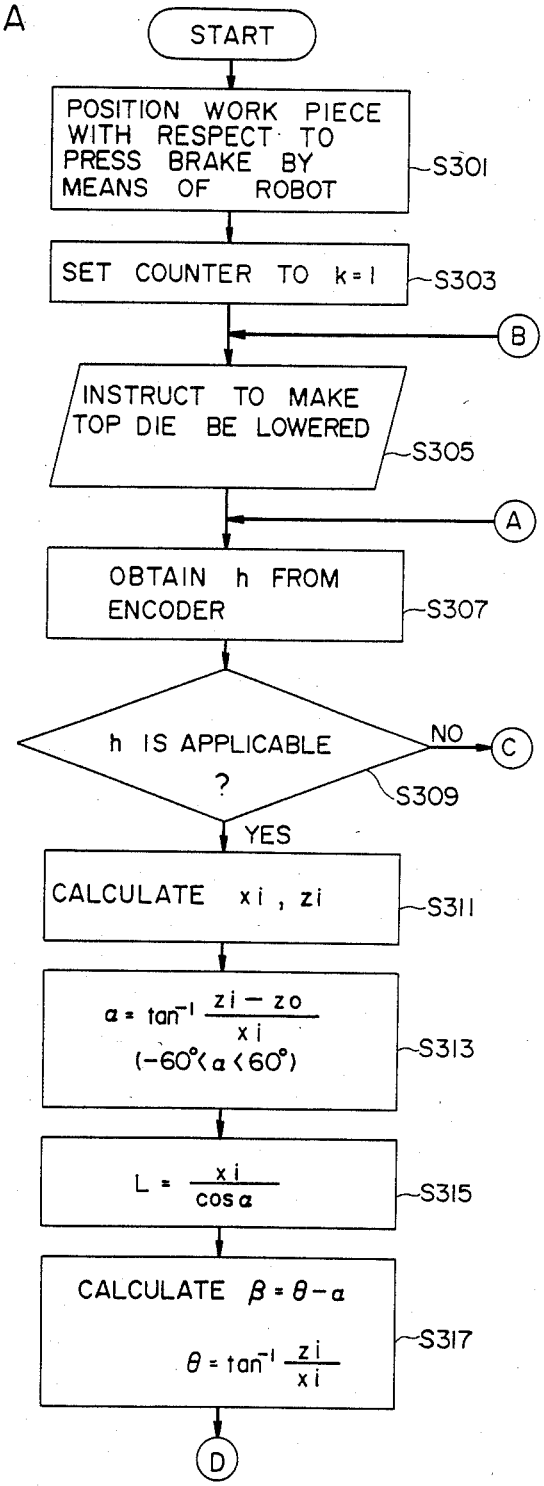
FIGS. 22A and 22B are flow charts for explaining the operation in the FIG. 20 embodiment.
Figure 22B:
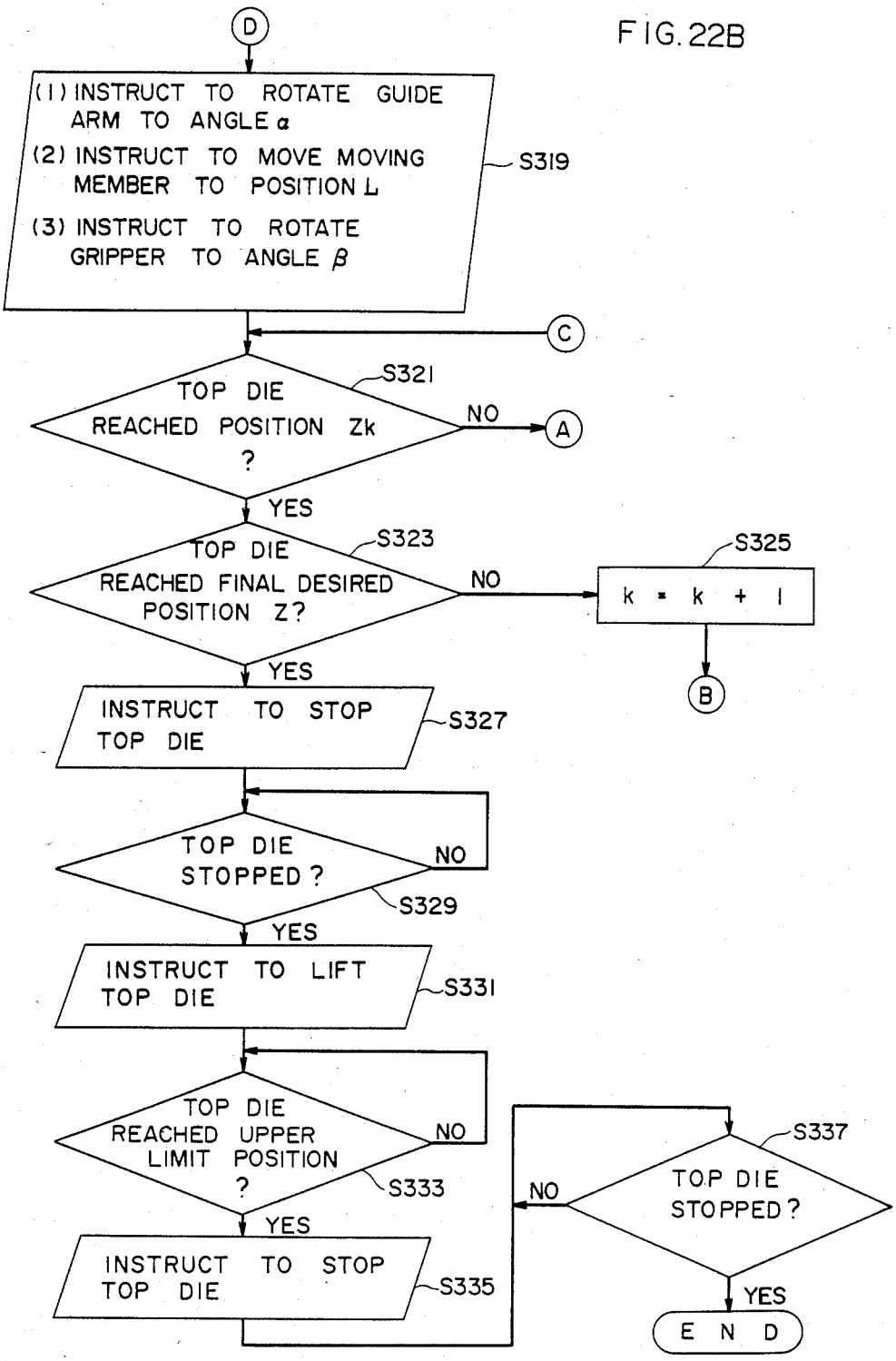

FIGS. 22A and 22B are flow charts for explaining the operation in this third embodiment. The flow charts shown in FIGS. 22A and 22B are almost the same as the above described flow charts in FIGS. 16A and 16B except that the date ($\alpha$), (L) and ($\beta$) are calculated respectively in the steps S313, S315 and S317 and the driving circuit is controlled in the step S319 according to the date ($\alpha$), (L) and ($\beta$) thus calculated, and therefore, further description thereof is omitted.

Figure 23:
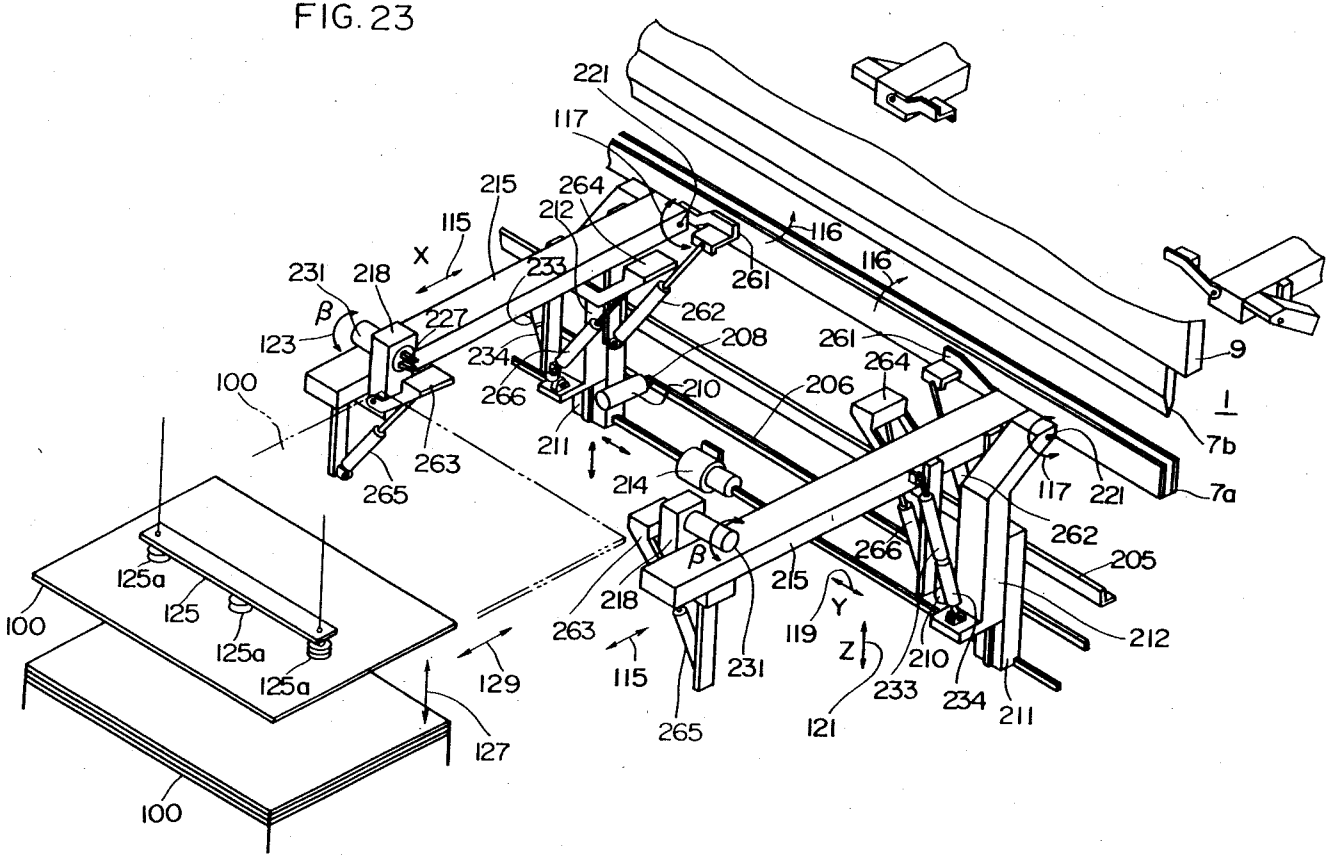
FIG. 23 is a perspective view showing an essential part of a further embodiment of the present invention.

FIG. 23 is a perspective view showing an essential part of still a further embodiment of the present invention. FIG. 23 shows only a part of the press brake type bending machine 1, that is, only the bottom die 7*a*, the top 7*b* and the ram 9 provided therein. In front of the bending machine 1, a pair of robot mechanisms on the carrying side disposed at both ends of the bending machine 1 in the transversal direction, in the same manner as in the previously described embodiment. Although the illustration of the robot on the transferring side provided in the rear of the bending machine 1 is omitted in FIG. 23, it is to be pointed out that the robot on the transferring side has almost the same structure as that of the robot on the carrying side. In front of the bending machine 1, there is provided a guide 215 extending in the forward and backward direction of the bending machine 1, that is, the direction shown by the arrow 115. In this guide 215, a moving member 218 is supported so as to be movable in the direction of the arrow 115. The moving member 218 is provided with a gripper 227 and also with a supporter 263 for supporting a plate or work piece thereon. The position of the supporter 263 is controlled by means of an actuator 265. Needless to say, the actuator 265 is also disposed in the moving member 218 so as to be movable together with the member. The movement of the moving member 218 is controlled by the oil hydraulic motor 231 in the direction shown by the arrow 115. More specifically, a pinion, though not shown, is connected to the oil hydraulic motor 231 so that the pinion is engaged with a rack, not shown (disposed along the guide 215). Consequently, the rotation of the oil hydraulic motor 231 makes the rack and the pinion (not shown) engage with each other so that the moving member 218 moves on the guide 215 in the X axis direction. If the actuator 265 is extended, the supporter 263 is made to be in the state shown in the drawing, so that the plate 100 can be supported on the supporter 263. If the actuator 265 is contracted, the supporter 263 is returned to the home position. Also in the vicinity of the rear end of the guide 215, a supporter 264 having the same structure as that of the supporter 263 is provided. This supporter 264 is fixed with respect to the X axis direction. The state or the position of the supporter 264 is controlled by means of an actuator provided between the supporter 264 and the guide 215. In the rear end of guide 215, a stopper 261 is provided. This stopper 261 is attached by an axis (not shown) so as to be rotatable in the direction shown by the arrow 116. The rotation of this stopper 261 is controlled by means of an actuator 262 provided between the stopper 261 and the guide 215. This actuator 262 is not the one controlled by the servo system.

In front of the bending machine 1, a guide 205 is provided in parallel with the transversal direction of the bending machine 1, and in association with this guide 205, a rack 206 is disposed in parallel. With this rack 206, a pinion 210 is engaged and this pinion 210 is coupled to the axis of the oil hydraulic motor 210, which is fixed to a stay 211. As a result, according to the displacement of this pinion 210 along the rack 206 in the direction of the arrow 119, control is made to move the stay 211 in the direction of the arrow 119, that is, the Y axis direction. On the other hand, a lifting and lowering member 212 is supported in the stay 211 so as to lifted or lowered in the direction of the arrow 121 (the Z axis direction). The lifting and lowering of this lifting member 212 with respect to the stay 211 is controlled using the oil hydraulic motor 214 provided, for example, in a lower portion of the bed 5 of the bending machine 1 through a known transmission mechanism (not shown).

The lifting and lowering member 212 has an upper end for supporting the guide 215 in a manner rotatable in the direction of the arrow 117 by means of an axis 221. Two actuators 233 and 234 are coupled between the guide 215 and the lifting and lowering member 212, so that the rotation of the guide 215 in the direction of the arrow 117 is controlled by these actuators 233 and 234. The actuators 233 and 234 are controlled by the oil hydraulic circuit as shown in FIG. 27.

Figure 27:
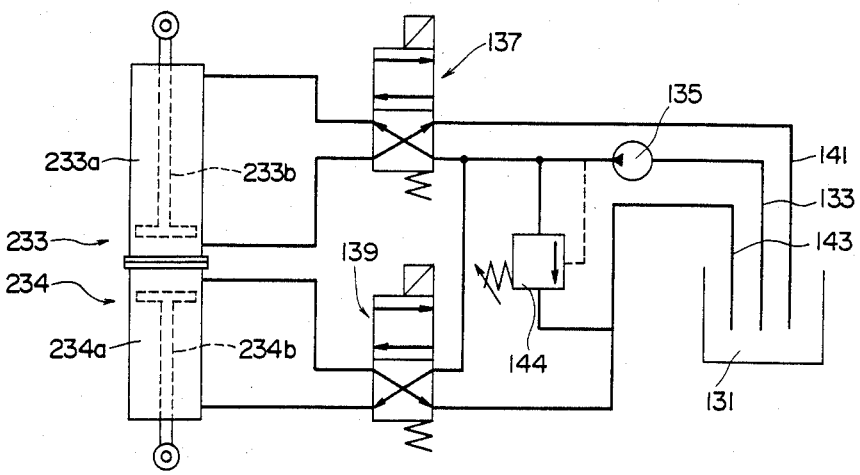
FIG. 27 shows an example of an oil hydraulic circuit of an actuator for rotating a guide.

FIG. 27 is a view showing an example of an oil hydraulic circuit for rotating the guide 215. A piping 133 extending from an oil tank 131 is connected to the four-port and two-position directional control valves 137 and 139 through an oil hydraulic pump 135. Pipings 141 and 143 are connected respectively to the directional control valves 137 and 139. A piping including a relief valve 144 is connected between the pipings 133 and 143. The four-port and two-position directional control valves 137 and 139 are connected respectively to cylinders 233*a* and 234*a*, where pistons 233*b* and 234*b* are respectively provided. The diameters of these pistons 233*b* and 234*b* are the same. However, the strokes of the pistons 233*b* and 234*are* different.

Such an oil hydraulic circuit as described above enables the actuators 233 and 234 to take four states or positions in all. For example, the guide 215 can be rotated with specified angles such as 0°, 30°, 45° and 60°. The relief valve 144 is set to a degree in which the force for pushing up the work piece is applied to the work piece.

Figure 3:
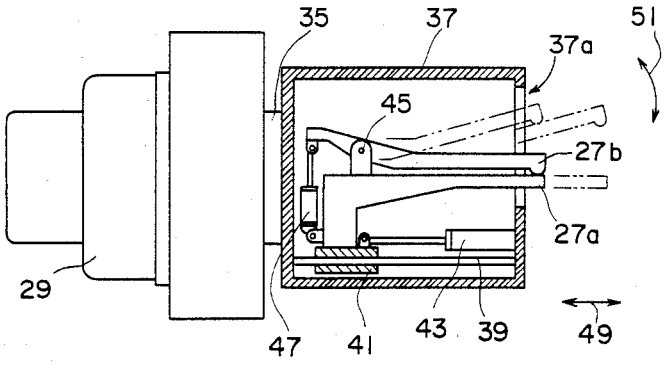
FIGS. 3 and 4 are views showing a gripper in detail.
Figure 4:
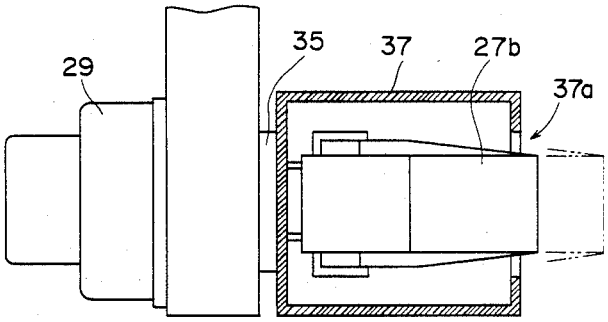

The gripper 227 provided in the moving member 218 may be have the same structure as that of the gripper controlled by the oil hydraulic motor 29 shown in FIGS. 3 and 4. Accordingly, the gripper 227 is rotated in the direction of the arrow 123 by means of the motor 29 (in FIG. 3).

Further ahead of the robot, plates, that is, work pieces 100 are stacked on a carriage (not shown). A one-sheet picking up means 125 is provided above the stacked plates. The one-sheet picking up means 125 includes, for example, vacuum pads 125*a* directed downward, which adhere to the uppermost sheet of work piece 100 so as to take the work pieces one by one. Though not shown, this one-sheet picking up means 125 can be lifted and lowered in the direction of the arrow 127 and can be moved in the direction of the arrow 129. Accordingly, the one-sheet picking up means 125 moves in the direction of the arrow 129 with the vacuum pads 125*a* adhering to a plate 100 so as to put the work piece 100 on the supporters 263 and 264 provided in the robot.

Figure 26:
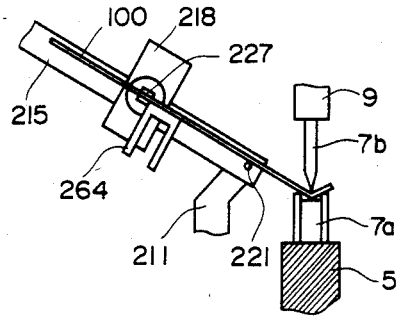

Now, referring to FIGS. 24 and 26, an outline of the bending operation in the embodiment in FIG. 23 will be described in the following.

Figure 24:
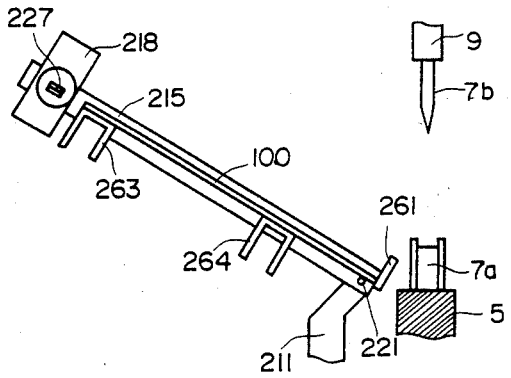
FIGS. 24 to 26 are views showing according to the order of processes a sequence of bending operations in the FIG. 23 embodiment.

When the plate or work piece 100 is put on the supporters 263 and 264 as described above, the one-sheet picking up means 125 is returned to the original position and then, the guide 215 is rotated with the supporting point 221 as a center so that the guide 215 is in the state shown in FIG. 24. As a result, one end of the work piece 100 put on the supporters 263 and 264 is in contact with the stopper 261.

Figure 25:
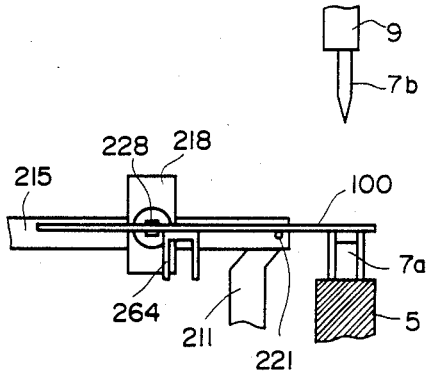

Subsequently, as shown in FIG. 25, the guide 215 is returned to the horizontal state and the moving member 218 is moved by the motor 231. At the same time, by controlling the actuators 43 and 47 (in FIG. 3), the work piece 100 is grasped by the gripper 23. By controlling the positions of the moving member 218 and the lifting and lowering member 212, the work piece 100 is positioned with respect to the bottom die 7*a* and the top die 7*b*. At this time, the stopper 261 is in the state lowered by the actuator 262 (namely, in the home position).

Then, the ram 9 of the bending machine 1 is lowered and as a result, the top die 7*b* is lowered. A bending load is applied to the positioned work piece 100 by means of the top die 7*b* and the bottom die 7*a*, so that the work piece 100 rises from the horizontal state (as shown in FIG. 26). Then, in order to follow up the rise of the work piece 100, the center of rotation of the gripper 27 is positioned successively.

Figure 28A:
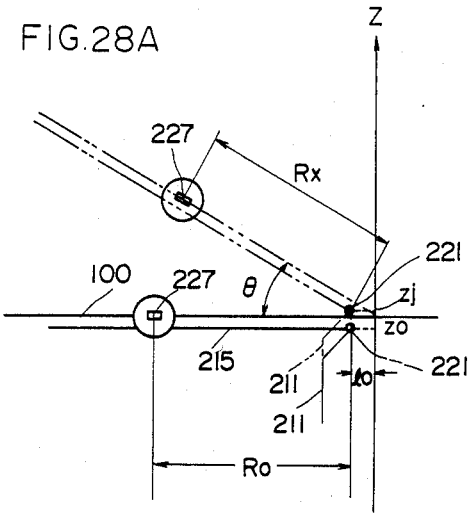
FIGS. 28A and 28B show models for obtaining the data necessary for control in the FIG. 23 embodiment.
Figure 28B:
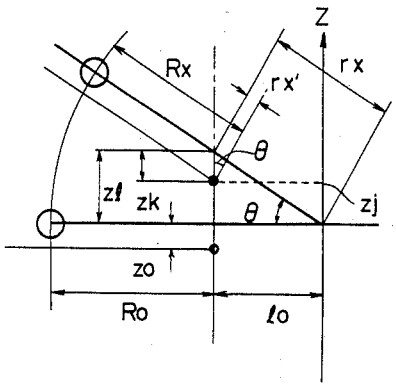

FIGS. 28A and 28B are models showing the embodiment in FIG. 23. FIG. 28B is an enlarged view of FIG. 28A. The angle with which the work piece 100 held by the gripper 27 rises when a bending load is applied to the work piece 100 by means of the top die 7*a* is assumed to be ($\theta$). The distance between the center of rotation of the gripper 227 and the center 221 of rotation of the guide 215 is assumed to be (Ro) and the rising distance of the work piece 100 is assumed to be (Rx). The distance between the bending point and the center 221 of rotation of the guide 215 is assumed to be (lo) and the position of the center 221 of rotation of the guide 215 in the Z axis direction is assumed to be (zo) and (zj). The position (zo) indicates the case where the work piece 100, that is, the guide 215 is in the horizontal state and the position (zj) represents a position when the work piece 100 is bent. In FIG. 28B, (zl) indicates the distance in the Z axis direction with respect to the work piece 100 in the position corresponding to the center of rotation of the guide 215 and (zk) indicates a difference between (zj) and (zl). (rx) indicates the distance from the bending point to the position corresponding to the center 221 of rotation of the guide 215 and (rx') indicates a longitudinal displacement amount of the guide 215 which is associated with the rising angle ($\theta$) and is caused by the distance zo between the guide 215 and the work piece 100.

From FIGS. 28A and 28B, it can be understood that the following equations (17), (18) and (19) are respectively established in the FIG. 23 embodiment.

$$\left.\begin{aligned} rx &= lo/\cos\theta \\ rx' &= zo\tan\theta \\ zk &= zo/\cos\theta \\ zl &= lo\tan\theta \\ Rx + rx - rx' &= Ro + lo \end{aligned}\right\} \quad (17)$$

$$\therefore Rx = Ro + lo - rx - rx' \quad (18)$$

$$zj = zl - zk + zo \quad (19)$$

By summarizing the equations (17), (18) and (19), the equations (20) and (21) are obtained assuming that the position of the center 221 of rotation of the guide 215 in the Z axis direction is (zj) and the position of the moving member 218 in the X axis direction is (Rx).

$$xj = lo\tan\theta - (zo/\cos\theta) + zo \quad (20)$$

$$Rx = Ro + lo - (lo/\cos\theta) + zo\tan\theta \quad (21)$$

As is clear from the above described equation (5), ($\theta$) is a function of the height (h) of the top die 7*b*. Accordingly, by calculating the rising angle ($\theta$) based on the data of the height (h), the control elements (zj) and (Rx) can be obtained.

In this embodiment, the bus 83 shown in FIG. 11 is connected with an actuator for rotating the guide 215, that is, a circuit for driving the control valves 137 and 139 (in FIG. 27), so that instructions are given to this circuit from the CPU 81. An oil hydraulic motor 214 for controlling the position (zj) of the lifting and lowering member 212 and an oil hydraulic motor 231 for controlling the position (Rx) of the moving member 218 are included respectively in the positioning apparatus 99 and 97 (in FIG. 11).

Figure 29A:
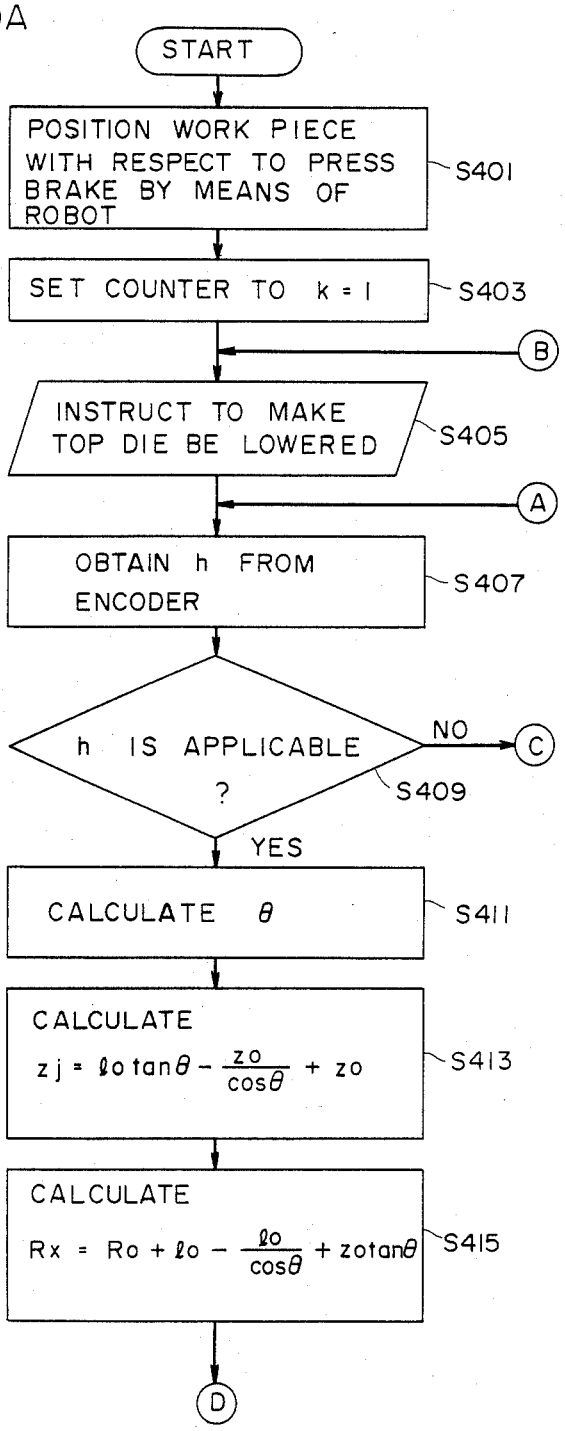
FIGS. 29A and 29B are flow charts for explaining the operation of the FIG. 23 embodiment.
Figure 29B:
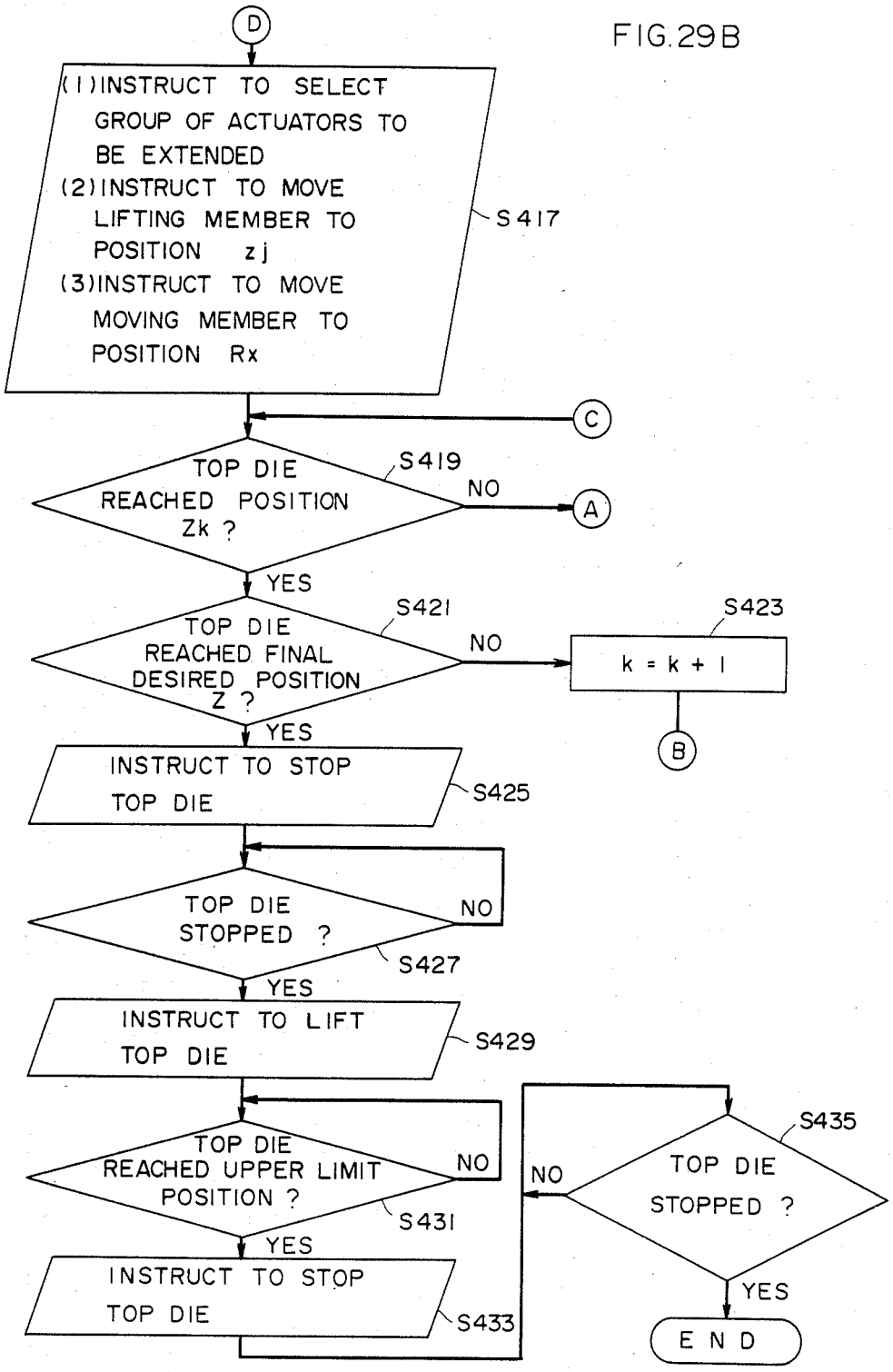

FIGS. 29A and 29B are flow charts for explaining the operation in the FIG. 23 embodiment. The flow charts of this embodiment are almost the same as the flow charts of the embodiment shown in FIGS. 16A and 16B except that the value ($\theta$), (zj) and (Rx) are calculated respectively in the steps S411, S413 and S415 shown in FIG. 29A whereby the follow-up control is made in the step S417, and therefore, in the following, only the steps S411 to S417 will be described.

In the step S411, the rising angle ($\theta$) of the work piece is calculated according to the equation (5). Then, in the step S413, based on the calculated angle ($\theta$) and other data, the position (zj) of the center 221 of rotation of the guide 215 in the Z axis direction is calculated. Subsequently, in the step S415, the position (Rx) of the moving member 218 is calculated. In the step S417, first, either of the groups of actuators 233 and 234 shown in FIG. 27 is selected according to the angle to be bent (which is taught in advance) so that instructions are given to the associated four-port directional control valve 137 or 139. Then, the guide 215 is inclined or rotated with an angle 0°, 30°, 45° or 60°. Subsequently, the CPU 81 gives instructions to the driving circuit of the positioning apparatus 97 so that the position of the lifting and lowering member 212 in the Z axis direction moves to (zj). At the same time, the CPU 81 gives instructions to the driving circuit of the positioning apparatus 99 so that the moving member 218 moves to (Rx).

As described above, the work piece or plate rises according to the height of the top die of the bending machine. However, according to the present invention, the position of the gripper means is controlled to follow up such rising, which enables the bending operation to be performed with the gripper means continually holding the work piece. Accordingly, it is not needed for the gripper means to release and newly hold the work piece, which makes the control easier. Furthermore, since the work piece is continually held by the gripper means during the bending operation, the work piece can be bent with an extremely high accuracy.

In all of the above described embodiments, description was made of a case in which a work piece is continually held by a gripper means during a sequence of bending operations, that is, during the positioning and bending operations with respect to the work piece. However, the present invention may be embodied as an apparatus where the work piece can be held by the gripper means at least during the bending process. Accordingly, for example, if a turn table is provided in a lower portion between the left and right guides 215 so as to perform bending operation in different bending lines, the present invention may be structured as an apparatus where a work piece is first bent along a bending line in a certain direction and then the gripper means is detached to put the work piece on the turn table, which is rotated to select a suitable position for bending line in a different direction, where the work piece is held again and positioned by means of the gripper means so as to be bent. Briefly stated, the work piece has only to be held by the gripper means during the bending process, that is, during the period in which a bending load is applied to the work piece by means of the top die.

In the following, another type of automatic bending apparatus will be described.

Figure 30:
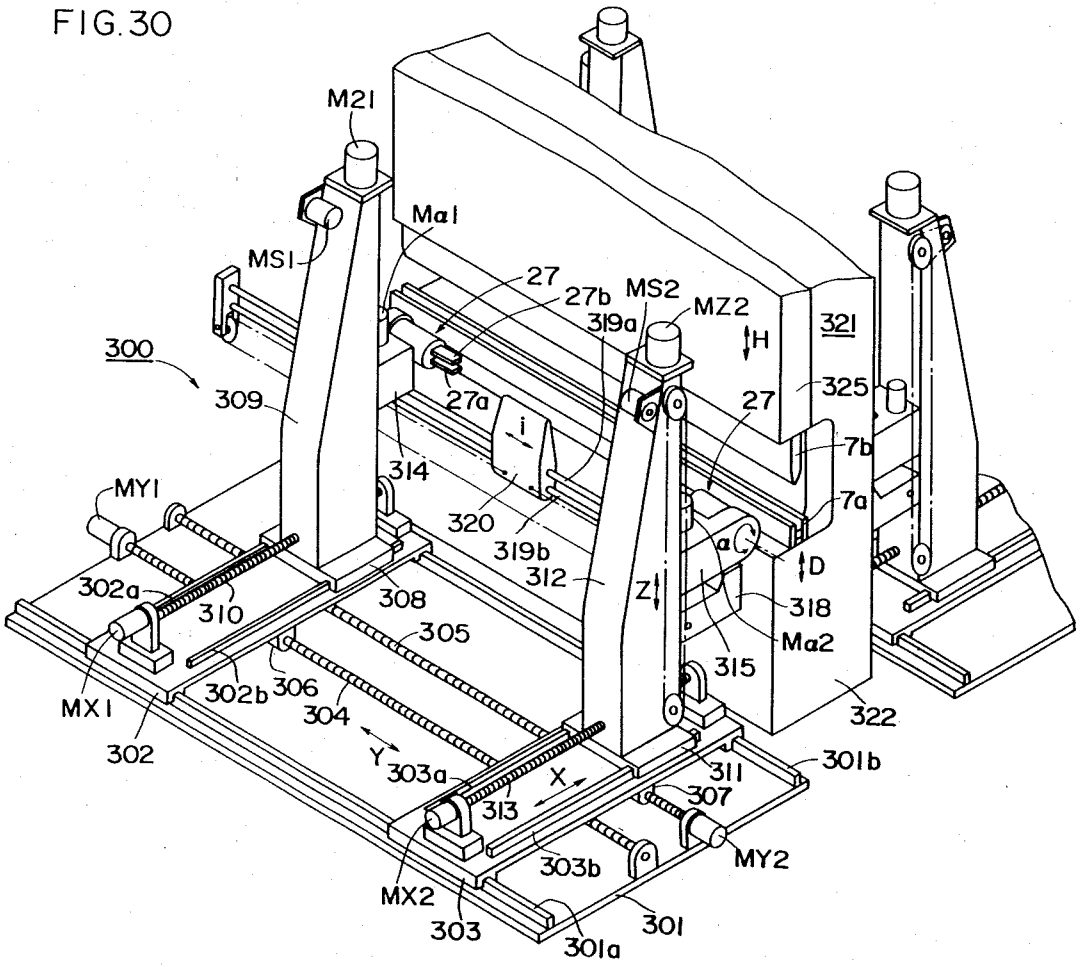
FIG. 30 is a perspective appearance view showing another type of automatic bending apparatus.

FIG. 30 is a perspective view showing another type of automatic bending apparatus. First, description will be made of a moving mechanism 300 for positioning the work piece. Although in this embodiment, two moving mechanisms 300 are disposed in front of and in the rear of the press brake type bending machine 321 described below in a manner opposed to each other, these two moving mechanisms have almost the same structure and therefore, the following description is made of the front moving mechanism, the description of the rear moving mechanism being omitted. Referring to FIG. 30, in both ends of the upper surface of a base table 301, two guide-rails 301*a* and 301*b* are provided in parallel. Tow sliding plates 302 and 303 are disposed so as to slide on these guide-rails 301*a* and 301*b*.

On the upper surface of the base table 301, bars 304 and 305 each having a groove formed in spiral are disposed in parallel with the guide-rails 301*a* and 301*b*. Each of the bars 304 and 305 has both ends supported rotatably, one end of the bar 304 and one end of the bar 305 being connected respectively to oil hydraulic motors MY1 and MY2. Accordingly, the bars 304 and 305 are rotated respectively by the oil hydraulic motors MY1 and MY2. In the bottom surface of the sliding plate 302, an engaging unit 306 is formed. The bar 304 is disposed so as to penetrate the engaging unit 306. The engaging unit 306 contains a ball to be engaged with the spiral groove formed in the bar 304. Specifically stated, the bar 304 and the engaging unit 306 constitute a so-called ball screw. Accordingly, the engaging unit 306 and the sliding plate 302 can be moved in the direction of the arrow Y according to the rotation of the bar 304. In the same manner, an engaging unit 307 is provided in the bottom surface of the sliding plate 303, so that the engaging unit 307 and the associated bar 305 constituted a so-called ball screw. Accordingly, the engaging unit 307 and the sliding plate 303 can be moved in the direction of the arrow Y according to the rotation of the bar 305. The relation between the bar 304 and the engaging unit 306 and the relation between the bar 305 and the engaging unit 307 are not limited to the ball screws, and a relation of a male screw and a female screw or a relation of a rack and a pinion may be applied.

In both ends of the upper surface of the sliding plate 302, guide-rails 302*a* and 302*b* are formed in parallel. A column table 308 is provided so as to slide on these guide-rails 302*a* and 302*b*. A column 309 is provided on the upper surface of the column table 308. On the upper surface of the sliding plate 302, a bar 310 having a groove formed in spiral is disposed in a parallel with the rails 302*a* and 302*b*. This bar 310 has both ends supported rotatably, one end thereof being connected with an oil hydraulic motor MX1. Accordingly, the bar 310 is rotated by the oil hydraulic motor MX1. In addition, the bar 310 penetrates the column 309. Inside the column 309, a ball to be engaged with the spiral groove formed in the bar 310 is provided so that this ball and the bar 310 constitute a so-called ball screw. Accordingly, the column 309 can be moved in the direction of the arrow X according to the rotation of the bar 310. For the mechanism for moving the column 309, any suitable mechanism other than the ball screw may be adopted, as described above.

On the other hand, guide-rails 303*a* and 303*b* are provided on the upper surface of the sliding plate 303 and a column table 311 is disposed so as to slide on these guide-rails 303*a* and 303*b*. On the upper surface of this column table 311, a column 312 is provided. This column 312 can be moved in the direction of the arrow X according to the rotation of the bar 313 provided with a spiral groove as in the above described bar 310. One end of the bar 313 is connected with an oil hydraulic motor MX2, so that the bar 313 is rotated by this oil hydraulic motor MX2.

On the upper end surface of the columns 309 and 312, oil hydraulic motors MZ1 and MZ2 are provided respectively. The oil hydraulic motor MZ1 serves to move, in the direction of the arrow Z, a gripper supporting member 314 provided in the side surface of the column 309. Similarly, the oil hydraulic motor MZ2 serves to move, in the direction of the arrow Z, a gripper supporting member 315 provided in the side surface of the column 312. The gripper supporting members 314 and 315 includes respectively grippers 27, 27 for holding the work piece (not shown). These grippers operate to hold the work piece by opening and closing of two claws (27*a* and 27*b*) provided in the end of each gripper. The opening and closing operations of these claws are performed by means of an oil hydraulic cylinder contained in the gripper 27. The gripper supporting members 314 and 315 include respectively oil hydraulic motors M$\alpha$1 and M$\alpha$2. The oil hydraulic motor M$\alpha$1 serves to rotate the gripper 27 on the side of the column 309 in the direction of the arrow $\alpha$. Similarly, the oil hydraulic motor M$\alpha$2 serves to rotate the gripper 27 on the side of the column 312 in the direction of the arrow $\alpha$.

On the side surfaces of the columns 309 and 312 where the above described gripper supporting members 314 and 315 are provided, supporter sustaining member 318 is further provided (the supporter sustaining member on the side of the column 309 is not shown in the drawing since it is hidden behind the column 309). To the supporter sustaining member on the side of the column 309 and the supporter sustaining member 318, rotating force of the oil hydraulic motor MS1 and that of the oil hydraulic motor MS2 are transmitted respectively. For the purpose of transmitting the rotating force, a transmission mechanism structured by a combination of a sprocket and a chain, for example, is provided. The supporter sustaining member on the side of the column 309 and the supporter sustaining member 318 can be moved in the direction of the arrow Z according to the rotation of the oil hydraulic motors MS1 and MS2. In these supporter sustaining members, two guide bars 319*a* and 319*b* extending in the direction of the arrow i are disposed in parallel. A supporter 320 is provided in association with these guide bars 319*a* and 319*b* so as to be movable along these guide bars. More specifically, the supporter 320 includes two apertures, through which the guide bars 319*a* and 319*b* are passed. To the supporter 320, the rotating force of an oil hydraulic motor Mi (for example, a motor provided in the supporter sustaining member 318, which is not shown in the drawing) is transmitted through the transmission mechanism structured by the combination of a sprocket and a chain. As a result, the supporter 320 moves in the direction of the arrow i according to the rotation of the above stated oil hydraulic motor Mi. This supporter 320 serves to support the work piece so that flection may not be caused in the work piece at the time of bending the work piece.

As described above, the moving mechanism 300 comprises a left half portion (on the side including the column 319) and a right half portion (on the side including the column 312) which are almost symmetrical in structure. At the time of holding and positioning the work piece, control is made so that the left half portion and the right half portion operate in synchronism.

It is to be pointed out that the moving mechanism is not limited to the one shown in FIG. 30 and various types of mechanism may be applied.

Now, description will be made of the structure of a press brake type bending machine 321 for bending the work piece positioned by the above described moving mechanism. The press brake type bending machine 321 includes a bed 322, on which a bottom die 7*a* is provided so that a groove thereof is directed upward. A top die 7*b* having an edge opposed to the groove of the bottom die 7*a* is attached to a ram 325. Lifting and lowering of this ram 325 are controlled by a control device to be described below. As to the bottom die 7*a* and the top die 7*b*, a plurality of dies having grooves and edges in different forms may be provided so that an arbitrary bottom die and an arbitrary top die can be selected among them according to the necessities.

Such a moving mechanism 300 as described above may be provided only on one side of the above described press brake type bending machine 321.

Figure 31:
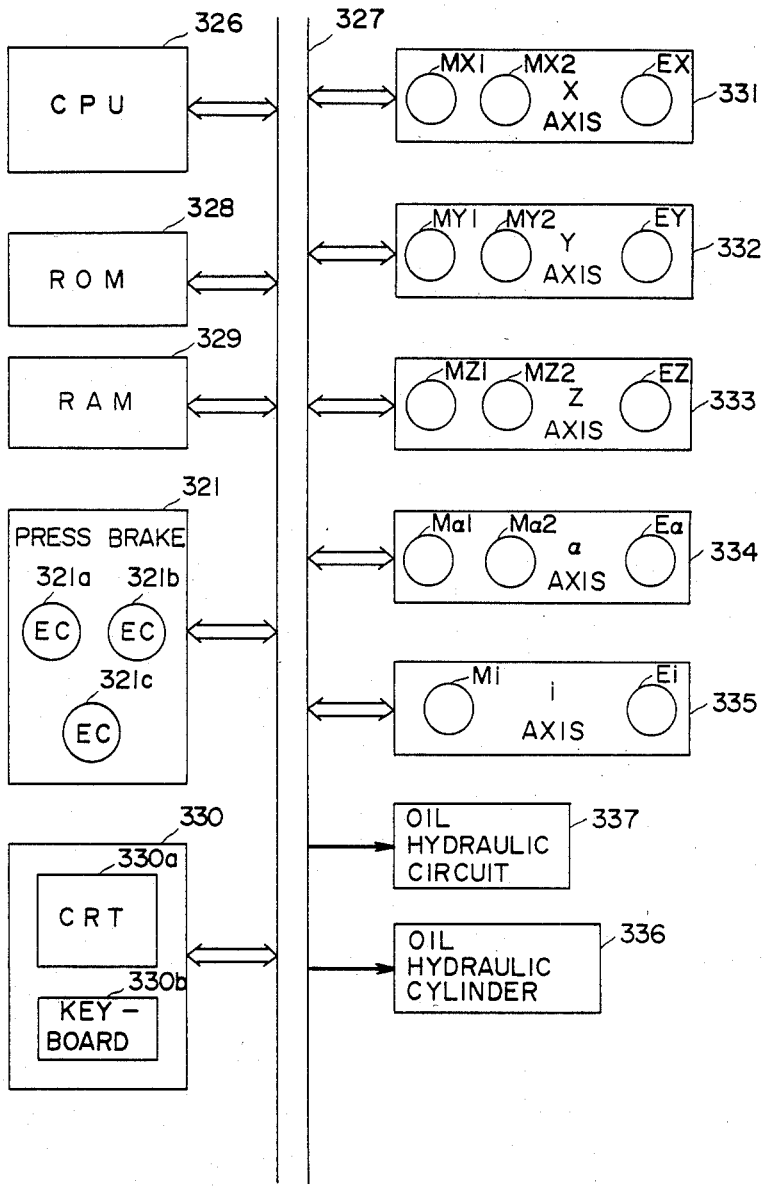
FIG. 31 is a schematic block diagram showing an electric circuit to be used in the apparatus shown in FIG. 30.

FIG. 31 is a schematic block diagram showing an electric circuit to be used in the apparatus shown in FIG. 30. Referring to FIG. 31, the CPU 326 is connected with the ROM 328 and RAM 329 through the bus 327. In the ROM 328, an operation program of the CPU 326, for example, is stored. The RAM 329 stores data necessary for calculation or control in the CPU 326. The bus 327 is connected with the console 330. This console 330 includes a cathode-ray tube (CRT) display 330*a*, a keyboard 330*b* and the like and serves to remotely control the press brake type bending machine 321, the moving mechanism 300 etc. or to perform the teaching operation for automatic bending. The information or data entered by means of the keyboard 330*b* is stored in the RAM 329 through the bus 327 and at the same time, supplied to the CPU 326. The console 330 displays, if necessary, the data entered from the keyboard 330*b* or other necessary information from the CPU 326 on the CRT display 330*a*.

The sub 327 is further connected with the press brake type bending machine 321, so that lifting and lowering of the top die 7*b*, that is, the ram 325 are controlled and the depth of the groove of the bottom die 7*a* is controlled. This press brake type bending machine 321 comprises encoders 321*a* and 321*b* for providing data according to the lifting and lowering of the ram 325 and an encoder 321*c* for providing data according to the depth of the groove of the bottom die 7*a*. The data from these encoders 321*a* to 321*c* are supplied to the CPU 326 and the RAM 329 through the bus 327.

Figure 32:
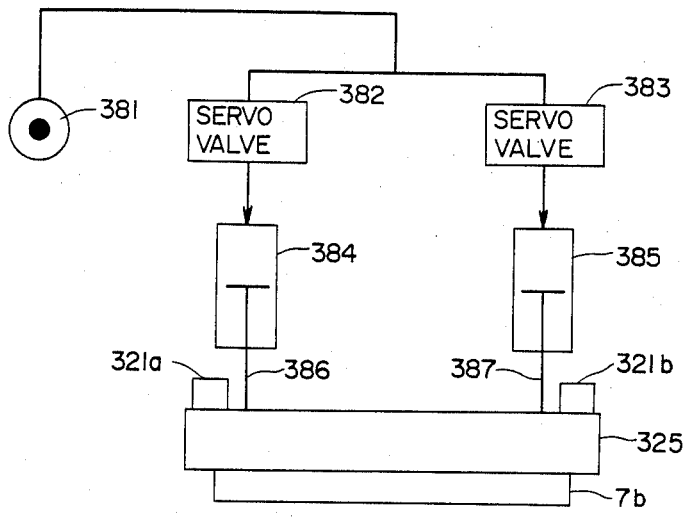
FIG. 32 is a schematic view of a structure for explaining a device for lifting and lowering a ram of a bending machine.

Now, referring to FIGS. 32 to 34, a further detailed structure of the press brake type bending machine 321 will be described. FIG. 32 is a schematic view for explaining a device for lifting and lowering the press brake type bending machine 321. Oil from an oil hydraulic source 381 is supplied to a cylinder 384 through a servo valve 382 and also supplied to a cylinder 385 through a servo valve 383. A piston 386 inserted in the cylinder 384 is connected to one end of the ram 325. On the other hand, a piston 387 inserted in the cylinder 385 is connected to the other end of the ram 325. Accordingly, the cylinder 384 serves to lift or lower one end of the ram 325, namely, the top die 7*b* according to the oil quantity supplied from the servo valve 382, while the cylinder 385 serves to lift or lower the other end of the ram 325, namely, the top die 7*b* according to the oil quantity supplied from the servo valve 383. The above described encoder 321*a* and 321*b* are disposed respectively in one end and the other end of the ram 325. The CPU 326 reads out and compares the data from these encoders 321*a* and 321*b* so that the total height of the top die 7*b* with respect to the bottom die 7*b* and inclination of the top die 7*b* with respect to the horizontal line can be made clear. Then, the CPU 326 gives instructions to the servo valves 382 and 383 so as to control totally the lifting and lowering of the top die 7*b*. If the CPU 326 determines that the top die 7*b* is inclined with respect to the horizontal line, instructions are given to the servo valves 382 and 383 so that the top die 7*b* may become horizontal. Then, the opening angles of the servo valves 382 and 383 are regulated and the quantities of oil supplied to the cylinders 384 and 385 are regulated. As a result, the positions of the pistons 386 and 387 are adjusted in the vertical direction, so that the top die 7*b* is maintained horizontal.

Figure 33:
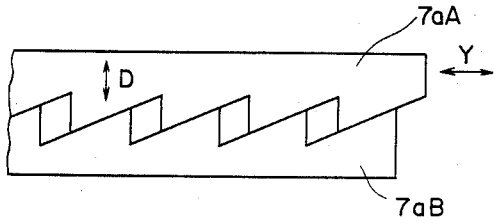
FIG. 33 is a view showing an internal structure of a bottom die.
Figure 34:
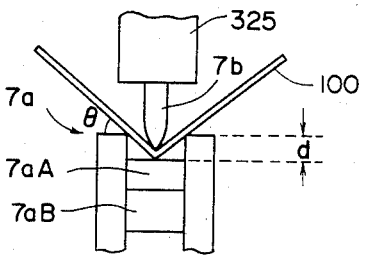
FIG. 34 is a view showing a state in which a work piece is bent between a top die and a bottom die.

FIG. 33 is a view showing an internal structure of the bottom die 7*a*. FIG. 34 is a view showing a state in which the work piece 100 is being bent between the top die 7*b* and the bottom die 7*a*. As shown in FIG. 33, the bottom die 7*a* includes a bottom member 7*a*A forming the bottom surface of the groove and a supporting member 7*a*B disposed under this bottom member 7*a*A. The lower surface of the bottom member 7*a*A has a section in the shape of the teeth of a saw. In the same manner, the upper surface of the supporting member 7aB is also formed to have a section in the shape of the teeth of a saw. The supporting member 7aB supports with its upper surface the lower surface of the bottom member 7aA. The bottom member 7aA is displaced in the direction of the arrow Y by means of an oil hydraulic motor not shown. By the displacement in the direction Y, the contact point between the bottom member 7aA and the supporting member 7aB is moved so that the height of the bottom member 7aA changes in the direction of the arrow D. In FIG. 33, if the bottom member 7aA moves to the right, the upper surface of the bottom member 7aA moves upward. As a result of the change in the height of the bottom member 7aA, the depth d of the groove of the bottom die 7a shown in FIG. 34 is changed. Accordingly, the bending angle of the work piece 100 can be changed.

Referring again to FIG. 31, the bus 327 is connected with an X axis servo system 331, a Y axis servo system 332, a Z axis servo system 333, an αaxis servo system 334 and an i axis servo system 335. The X axis servo system 331 includes oil hydraulic motors MX1 and MX2 and an encoder EX. The encoder EX serves to detect a displacement amount of the columns 309 and 312 in the direction of the arrow X (see FIG. 30). The Y axis servo system 332 includes oil hydraulic motors MY1 and MY2 and an encoder EY. The encoder EY serves to detect a displacement amount of the columns 309 and 312 in the arrow Y direction. The Z axis servo system 333 includes oil hydraulic motors MZ1 and MZ2 and an encoder EZ. The encoder EZ serves to detect a displacement amount of the gripper supporting members 314 and 315 in the arrow Z direction. The α axis servo system 334 includes oil hydraulic motors MαI and Mα2 and an encoder Eα. The encoder Eα serves to detect a rotating angle of the gripper 27 in the arrow α direction. The i axis servo system 335 includes an oil hydraulic motor Mi and an encoder Ei. The encoder Ei serves to detect a displacement amount of the supporter 320 in the arrow i direction.

The bus 327 is further connected with an oil hydraulic cylinder 336 for opening and closing the gripper. This oil hydraulic cylinder 336 serves to open and close the claws provided in the end of the gripper 27. Furthermore, the bus 327 is connected with an oil hydraulic circuit 337 for supporter for driving the oil hydraulic motors MS1 and MS2.

Figure 35:
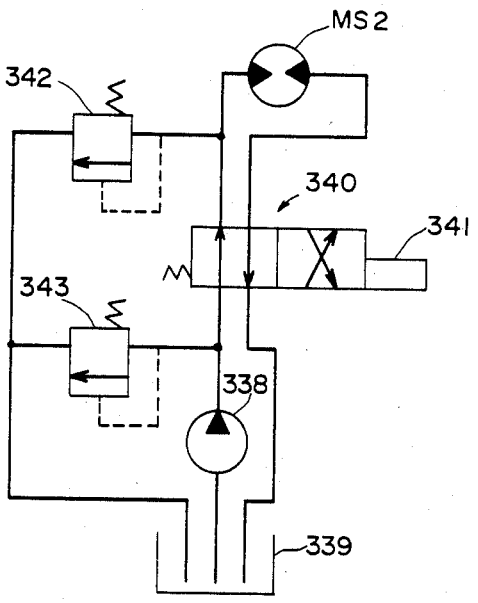
FIG. 35 is a view showing an example of an oil hydraulic circuit for supporter.

FIG. 35 is a view showing an example of the above described oil hydraulic circuit 337 for supporter. An oil hydraulic pump 338 supplies the oil sucked up from an oil tank 339 to one end of the oil hydraulic motor MS2 through the four-port two-postion directional control valve 340. The oil evacuated from the other end of the oil hydraulic motor MS2 is returned to the oil tank 339 through the four-port two-position directional control valve 340. More specifically, a closed circulation loop of compressed oil is formed with the oil tank 339, the oil hydraulic pump 338, the four-port two-position directional control valve 340 and the oil hydraulic motor MS2, so that the oil hydraulic motor MS2 is rotated. The four-port two-position directional control valve 340 serves to reverse the circulating direction of oil in the above described closed circulation loop of compressed oil and by enabling or disabling a solenoid 341, the four-port two-position directional contol valve 340 is made to change the circulating direction. When the circulating direction of oil is reversed by means of this four-port two-position directional control valve 340, the oil hydraulic motor MS2 rotates in the direction opposite to the previously rotating direction. Accordingly, the movement of the supporter sustaining member 318, and therefore the supporter 320 is changed from lifting to lowering or from lowering to lifting. The above described CPU 326 controls enabling and disabling of the solenoid 341 so as to control lifting and lowering of the supporter 320. The relief valve 342 is made to open when the supporter sustaining member 318 is brought into contact with the gripper supporting member 315 and a predetermined pressure for making the supporter sustaining the supporter sustaining member 318 push up the gripper supporting member 315 is applied thereto. At the time of bending the work piece, force in the rising direction is constantly applied to the supporter 320 by means of the oil hydraulic motor MS2 so that the work piece is supported. However, when the gripper supporting member 318 is at a stop, the oil hydraulic motor MS2 is not rotated and therefore, the relief valve 342 operates so that the compressed oil supplied to the oil hydraulic motor MS2 may flow back to the oil tank 339. On the other hand, the relieve valve 343 is made to open when the supporter sustaining member 318 is lowered to the lowest position of the column 312 and a predetermined pressure for further lowering the supporter sustaining member 318 is applied thereto. Thus, the supporter 320 is lowered to the lowest end, where the supporter 320 is maintained, if the use thereof is not needed. Although the oil hydraulic circuit for the oil hydraulic motor MS2 was described in the foregoing with reference to FIG. 35, the oil hydraulic circuit 337 for supporter includes also an entirely identical oil hydraulic circuit for the oil hydraulic motor MS1.

Embodiment in which a bottom die is lifted and lowered

In the following, an embodiment in which a bottom die is lifted and lowered will be described referring to the type of apparatus shown in FIG. 30. In the FIG. 30 apparatus, bending of the work piece can be made by lifting and lowering the bottom die 7a instead of lifting and lowering the top die 7b. A device for lifting and lowering the bottom die 7a is the same as shown in FIG. 32. In this case, the above described encoders 21a and 21b provide data according to the lifting and lowering of the bottom die 7a. A theoretical base in the case of lifting the bottom die 7a is exactly the same as that described previously in conjunction with FIGS. 13 and 14. Specifically stated, except that the bottom die 7a is lifted in this embodiment instead of lowering the top die 7b, relative relation between the top die 7b and the bottom die 7a is not changed as compared with the previously described embodiment. Accordingly, the above described equations (1) to (6) are also established in this embodiment. Therefore, in the same manner as in the previously described embodiment where the top die 7b is lifted and lowered, the rising angle ($\theta$) of the work piece 100 can be represented as a function of the height (h) of the bottom die 7a and the position (xi, zi) of the center of rotation of the gripper 27 can be represented as a function of the height (h) of the bottom die 7a in this embodiment.

In this embodiment also, a position of the center of rotation of the gripper 27 is calculated successively according to the change in the height (h) of the bottom die 7a, and based on the calculated position data, the angles and positions of necessary control axes are calculated so as to control oil hydraulic motors MX1, MX2, MZ1, MZ2, M1, M2 etc., for example, whereby bending operation can be made with the gripper 27 continuously holding the work piece 100.

Figure 36:
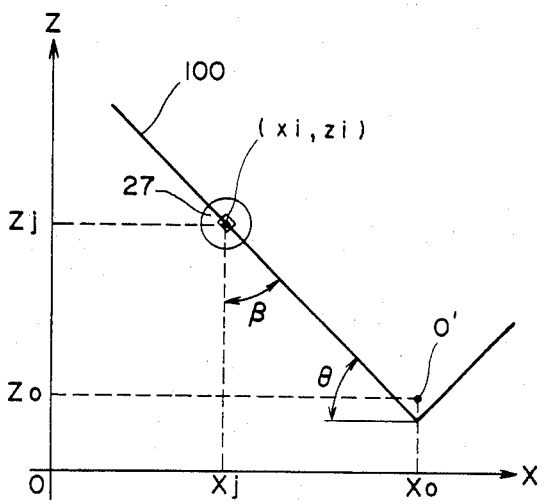
FIG. 36 is a model for obtaining the data necessary for control in an embodiment where a bottom die is lifted and lowered.

Referring to FIG. 36, description will be made of a relation between a position (xi, zi) in the coordinate system of the bending machine 321 and a position (xj, zj) of the coordinate system of the moving mechanism 300 in this embodiment. FIG. 36 shows a model for obtaining the data necessary for control in the embodiment where the bottom die is lifted and lowered. Using the position (xi, zi) of the center of rotation of the gripper 27 and the rising angle ($\theta$) calculation of the positions (xj) of the columns 309 and 312 with respect to the sliding plates 302 and 303, calculation of the postions (zj) of the gripper supporting members 314 and 315 with respect to the columns 309 and 312 and calculation of the rotating angle ($\beta$) of the gripper 27 are performed respectively according to the equations (22), (23) and (24). In FIG. 36, the point O' indicates an origin in the coordinate system of the bending machine 321 and (xo, zo) represent coordinates of the origin O' in the coorindate system of the bending machine 321 as viewed from the coordinate system of the moving mechanism 300.

$$xj = xo + xi \tag{22}$$

$$zj = zo + zi \tag{23}$$

$$\beta = 90 - \theta \tag{24}$$

The values xi, zi and $\theta$ in the above described equations can be obtained from the previously stated equation (6) etc. Accordingly, in this embodiment, positions of the columns 309 and 312, the gripper supporting members 314 and 315 and the gripper 27 need to be controlled so as to satisfy the above described equations (22), (23) and (24).

Figure 37:
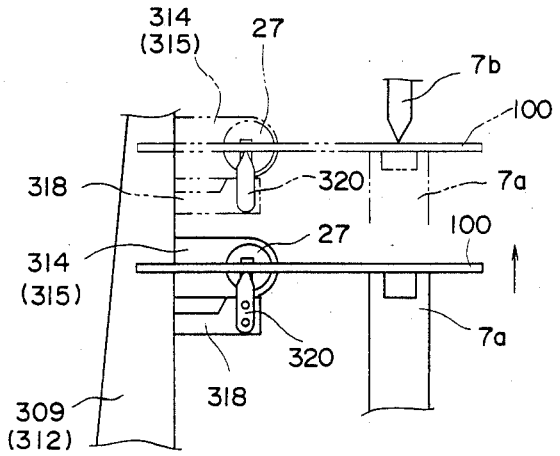
FIGS. 37 and 38 are views explaining bending processes in the embodiment where a bottom die is lifted and lowered.
Figure 38:
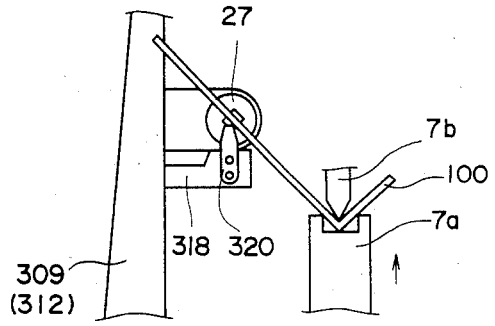
Figure 39A:
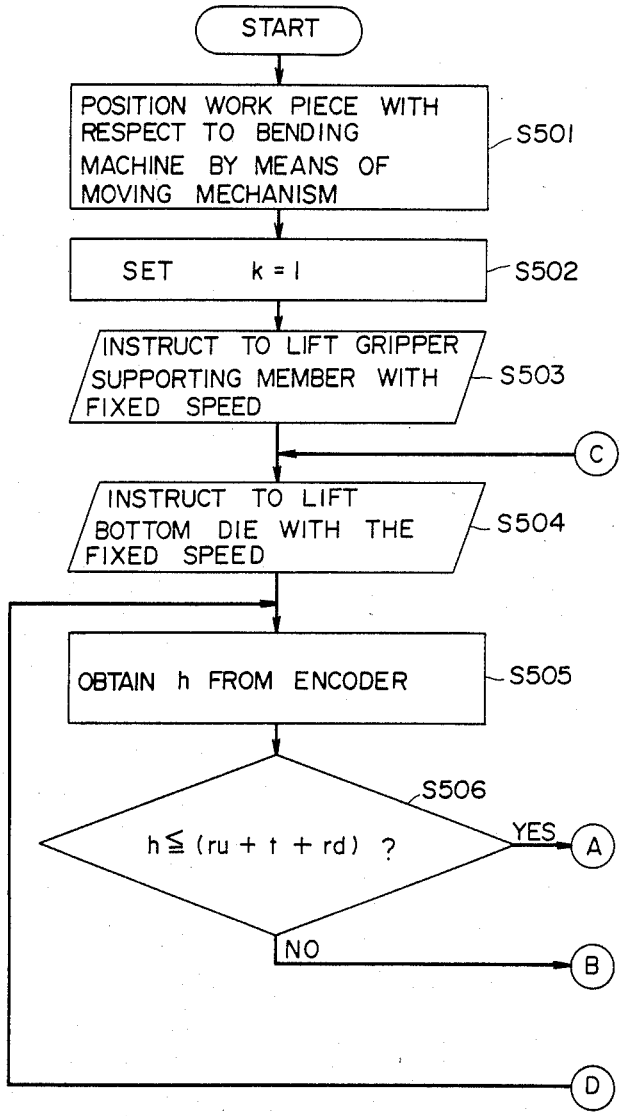
FIGS. 39A and 39B are flow charts for explaining the operation in the embodiment where a bottom die is lifted and lowered.
Figure 39B:
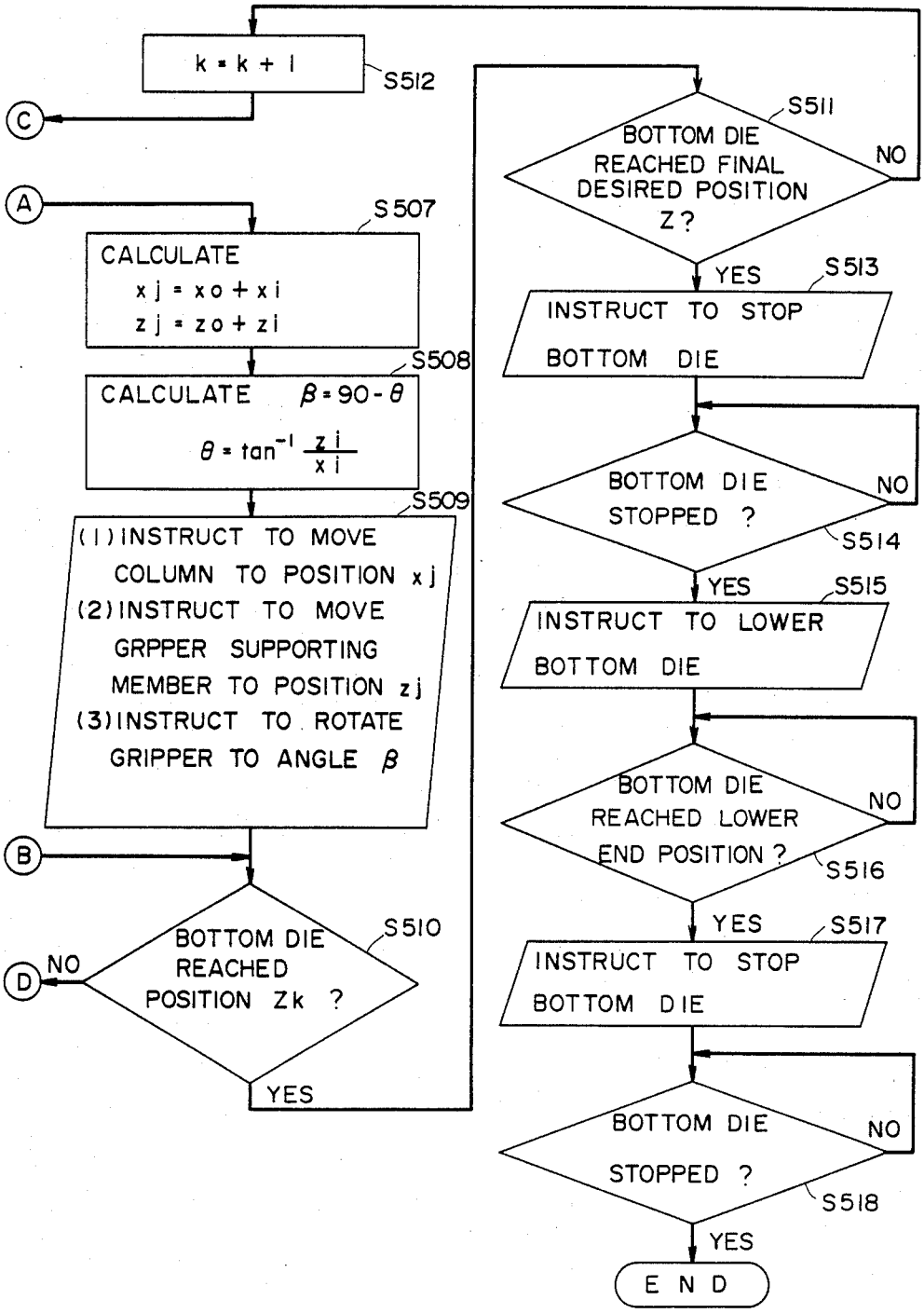

Now, the operation in this embodiment will be described with reference to FIGS. 37 and 38, using FIGS. 39A and 39B. FIGS. 37 and 38 are views explaining the bending processes. FIGS. 39A and 39B are flow charts for explaining the operation in the embodiment where the bottom die is lifted and lowered. It is assumed that left and right portions of the work piece 100 are already gripped by control of the oil hydraulic motors and cylinders by the CPU 326 (in FIG. 31). In addition, it is assumed that the control valve 340 is in the left position as in FIG. 35 and a predetermined rising force is applied to the supporter sustaining member 318, causing the upper end of the supporter sustaining member 318 to be pushed against the lower surfaces of the gripper supporting members 314 and 315, whereby the supporter sustaining member and the gripper supporting members are made to be in a combined state. Furthermore, the supporter 320 is assumed to be positioned almost in the center from the left and right columns 309 and 312. In consequence, the central portion in the left and right direction of the work piece held by the gripper 27 is supported by the supporter 320, whereby flection can be avoided.

In the step S501, the CPU 326 controls the respective oil hydraulic motors so as to position the work piece held by the gripper 27 with respect to the bending machine 321 as shown by the solid line in FIG. 37. In the step S502, the content k of the counter provided in the RAM 329 is set to 1. In the step S503, the CPU 326 instructs the Z axis servo system 333 to lift the gripper supporting member 315 with a fixed speed. At the same time, the CPU 326 instructs the oil hydraulic circuit 337 for supporter to lift the supporter sustaining member 318 with a fixed speed. In the step S504, the CPU 326 instructs the bending machine 321, simultaneously with providing the instruction in the step S503, to lift the bottom die 7a with the above stated fixed speed. As a result, the gripper supporting members 314 and 315, the supporter sustaining member 318 and the bottom die 7a are all lifted simultaneously at the same speed. At this time, in the step S505, data corresponding to the height (h) of the bottom die 7a is entered from the encoders 321a and 321b to the CPU 326.

In the step S506, it is determined based on this height (h) whether the model explained in conjunction with FIGS. 13 and 14 is applicable or not. More specifically, it is determined whether the condition $h \leqq (ru+t+rd)$ is satisfied or not, in other words, whether the upper surface of the work piece 100 is brought into contact with the lower end of the top die 7b as shown by the chained line in FIG. 37. If the height h is larger than (ru+t+rd), it means that the work piece 100 is not in contact with the top die 7b, and since the above described model cannot be applied, the program advances directly to the step S510. If the condition $h \leqq (ru+t+rd)$ is satisfied, the program proceeds to the subsequent step S507, in which the CPU 326 calculates the position (xj, zj) of the center of rotation of the gripper 27 according to the equation (22) and (23). In addition, in the step S508, the CPU 326 calculates the angle $\beta$ of the gripper 27 according to the equation (24). In the step S509, the CPU 326 provides instruction to the X axis servo system 331 to move the columns 309 and 312 to the position (xj), and provides instruction to the Z axis servo system 333 to move the gripper supporting members 314 and 315 to the position (zj) and provides instruction to the $\alpha$ axis servo system 334 to rotate the gripper 27 to the angle $\beta$. Thus, by making the point for holding the work piece 100 follow up the rising motion of the work piece, the work piece 100 can be bent with the gripper 27 continuously holding the work piece 100.

Subsequently, in the step S510, the CPU 326 determines whether the bottom die 7a attains the desired position Zk or not. This determination is made based on the data from the bending machine 321. If the bottom die 7a does not reach the position Zk, the program returns to the step S505. If the bottom die 7a attains the position Zk, the CPU 326 determines in the step S511 whether the bottom die 7a attains the final desired position Z. This determination is made by examining whether the content k of the counter provided in the RAM 329 reaches the number necessary for one bending operation. If the bottom die 7a does not attain the final desired position Z, the CPU 326 increments, in the step S512, the content k of the counter in the RAM 329. Then, the program returns to the step S504. If the bottom die 7a attains the final desired position Z, it follows that the work piece 100 is completely bent as shown in FIG. 38 and in the step S513, the CPU 326 provides instruction to the bending machine 326 to stop the bottom die 7a. If the stop of the bottom die 7a is detected in the step S514, the CPU 326 carries out the operations in the steps S515 to S518 so that the bottom die 7a is returned to the initial position, that is, the lower end position. Thus, the follow-up control of the center of rotation of the gripper 27 is performed.

If the first bending operation is completed, flection of the work piece 100 in the state held by the gripper 27 is decreased and therefore, as far as such flection does not influence unfavorably the operation of bending, the second and subsequent bending operations may be performed in the state in which the control valve 340 is selected to be in the right position and the supporter sustaining member 318 is lowered, making the supporter 320 detached from the work piece 100.

As is different from the foregoing description, either one of the moving mechanisms 300 before and behind the bending machine 321 may be omitted. The moving mechanism 300 may be structured by a mechanism in a polar coordinate system or an articular coordinate system mounted on the sliding plates 302 and 303. In this case, the position (xi, zi) of the center of rotation of the gripper 27 can be obtained as a position of each control axis in the polar coordinates or articular coordinates of the moving mechanism 300, not in the Cartesian coordinates as in FIG. 36.

In this embodiment also, positioning control is made to enable the position of the gripper 27 to follow up the rising motion of the work piece 100 corresponding to the height (h) of the bottom die *7a*, and accordingly, in the same manner as in the embodiment in which the top die is lifted and lowered, the work piece 100 can be bent with the gripper 27 continuously holding the work piece 100. In other word, in the state where the work piece 100 is held by the gripper 27, a bending load can be applied to the work piece 100 by means of the bottom die *7a*. Accordingly, it is not necessary for the gripper 27 to change the holding position of the work piece 100, which makes control easier. In addition, bending of the work piece 100 can be made with an extremely high accuracy.

Embodiment in which delay of response can be corrected

In the above described embodiments, positioning control of a top die (or a bottom die) and a gripper is controlled based on the position instructions, but sometimes a delay of response occurs due to force of inertia etc. In consequence, irregularities might be caused in the moving speed of the top die (or the bottom die) and the gripper, making the movement not smooth. As a result, it is feared that overload might be applied to the bending apparatus or the work piece, causing deformation and the like thereto.

Therefore, the following description will be made of an embodiment in which delay of response with respect to the position instructions can be corrected.

Briefly stated, according to this embodiment, the positioning of either the top die or the bottom die is controlled successively according to the position instructions given by successively calculation in first calculating means and a follow-up position of the gripper is calculated successively in second calculating means so as to make the gripper follow up the displacement of the plate caused by bending, whereby the positioning of the gripper is controlled according to the calculated follow-up position. Furthermore, in this embodiment, the above described second calculating means calculates, with moving speed of the gripper as a parameter, an element for correction of a delay of response in the gripper positioning control means with respect to the position instructions and establishes the position instructions taking account of this element for correction.

Figures 40, 44:
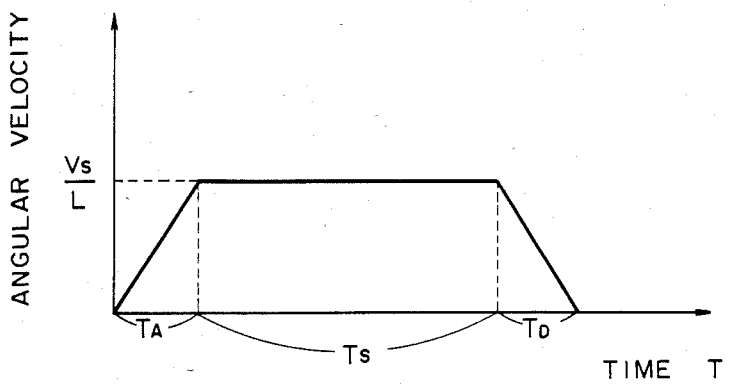
FIG. 40 is a graph showing a relation between a lapse of time from the beginning of bending of a work piece and angular velocity of a bending angle of a work piece.
FIG. 44 is illustration of a P-Q table stored in a predetermined area in a random access memory (RAM) shown in FIG. 31.
Figure 41:
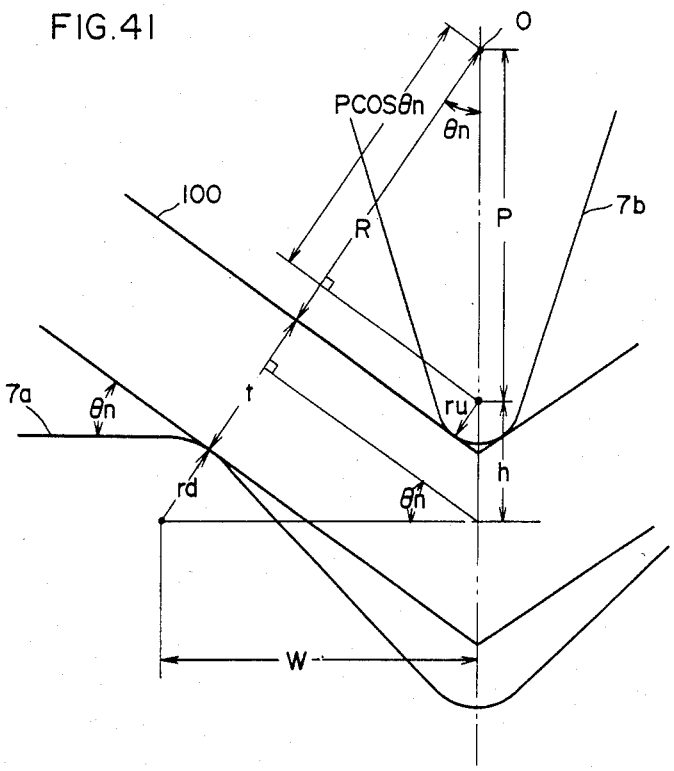
FIG. 41 is a model showing a relation between top and bottom dies and a work piece during the bending operation.
Figure 42:
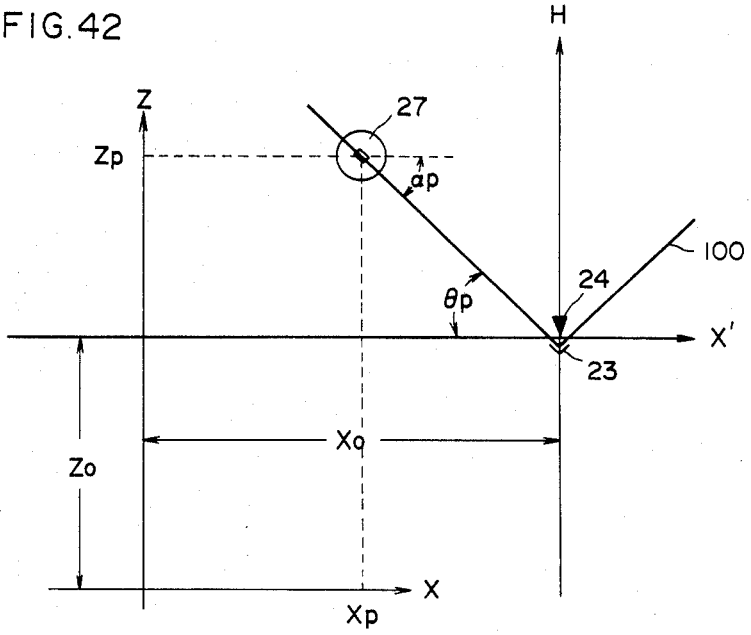
FIG. 42 is a model for calculating the instructed positions of the respective control axes of a moving mechanism.
Figure 43A:
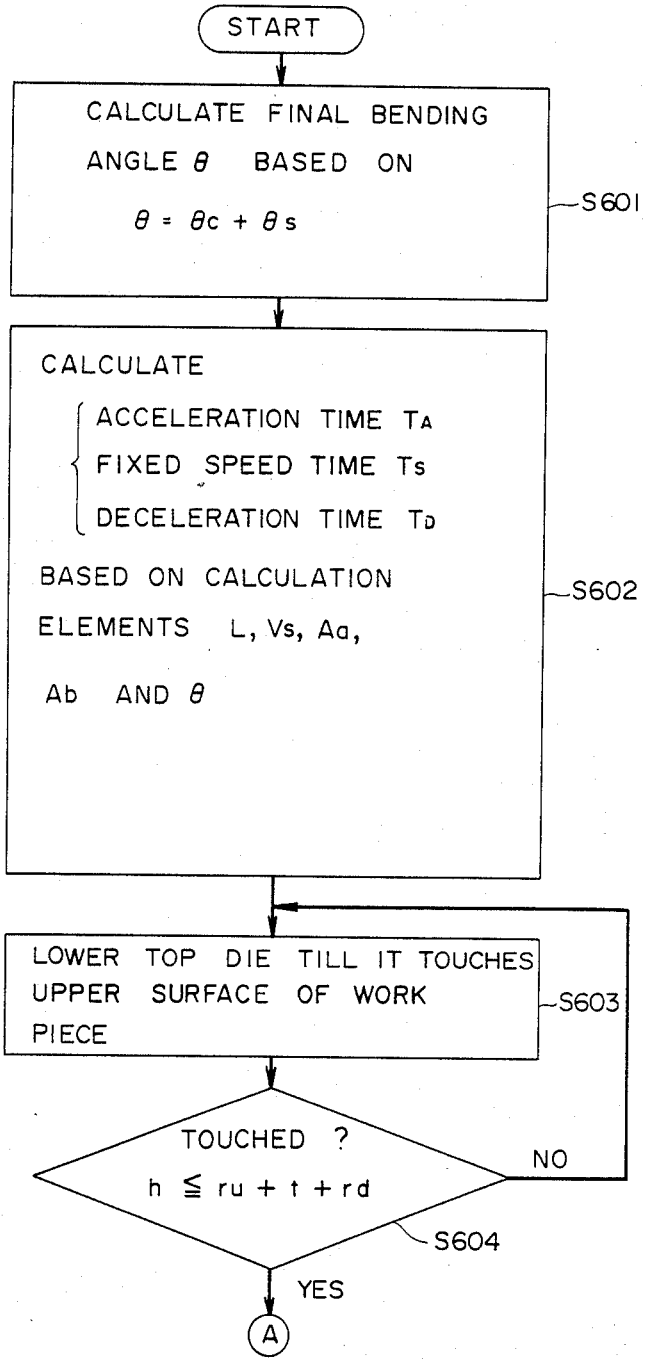
FIGS. 43A to 43C are flow charts for explaining the operation of a central processing unit (CPU) shown in FIG. 31.
Figure 43B:
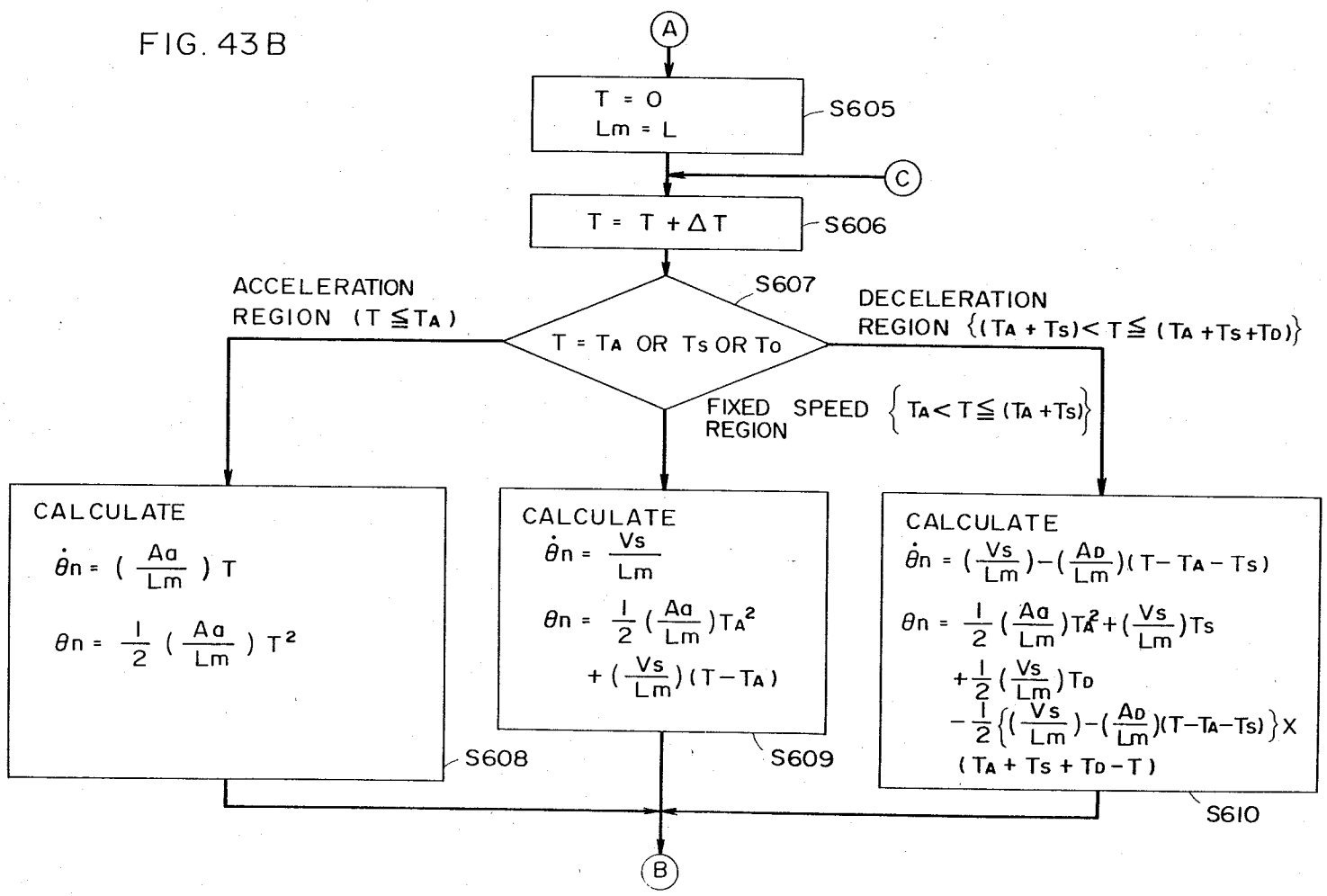
Figure 43C:
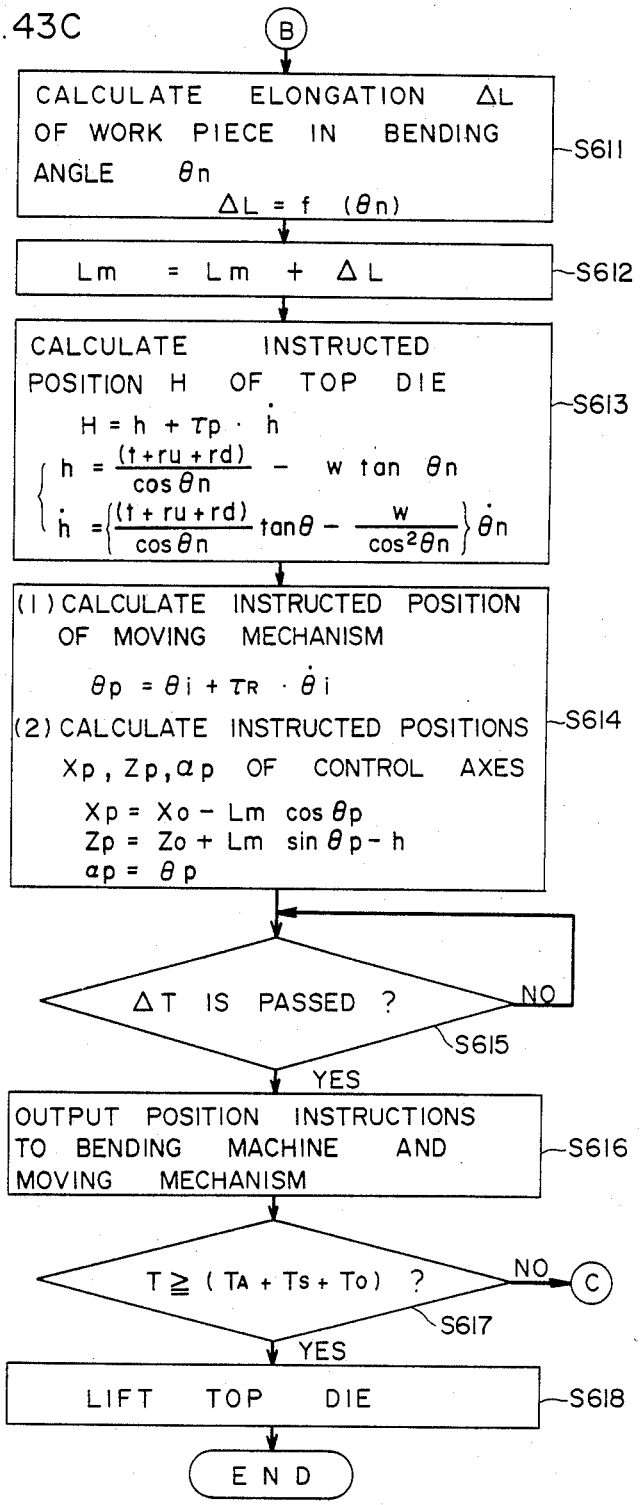

In the following, this embodiment will be described in detail. FIG. 40 is a graph showing a relation between a lapse of time from the start of bending of the work piece and an angular velocity of the bending angle of the work piece. FIG. 41 is a model showing a relation between the top and bottom dies and the work piece during the bending operation. FIG. 42 shows a model for calculating the position of the gripper 27 to be controlled. FIGS. 43A to 43C are flow charts for explaining the operation of the CPU 326 shown in FIG. 31. The following description will be made of the operation in the above described embodiment with reference to these FIGS. 40 to 43C.

First, as shown in the step S601 in FIG. 43A, a final bending angle $\theta$ of the work piece 100 is calculated. This calculation is made according to the following equation (25).

$$\theta=\theta_c+\theta_s \tag{25}$$

where $\theta_c$ is a bending angle for finishing and $\theta_s$ is a spring back amount. Normally, the work piece is returned toward the original state with a small angle when it is released from the state bent between the top and bottom dies. This small angle is a spring back amount. Accordingly, an angle obtained by subtracting the spring back amount $\theta_s$ from the final bending angle $\theta$ becomes the bending angle $\theta_s$ for finishing. Subsequently, the operation in the step S602 is performed. In this step S602, acceleration time $T_A$ for increasing the bending speed of the work piece 100, time $T_S$ for maintaining a fixed speed and deceleration time $T_D$ are calculated. The calculation of the acceleration time $T_A$, fixed speed time $T_S$ and deceleration time $T_D$ is made using the following elements ① to ⑤ as calculation elements.

① distance L between the bending center of the work piece 100 and the center of rotation of the gripper 27
② maximal permitted speed $V_s$ of the gripper 27 obtained by the capacity of each control axis
③ acceleration $A_a$ at the time of acceleration
④ acceleration $A_b$ at the time of deceleration
⑤ final bending angle $\theta$ The above stated elements ① to ⑤ are set or calculated at the time of bending the work piece. The elements ② to ④ are fixedly determined in advance. As shown in FIG. 40, the bending speed of the work piece 100 (that is, angular velocity of the bending angle) is increased with the fixed acceleration A*a* during the time $T_A$ from the start of bending. As a result of this acceleration, the bending speed of the work piece 100 attains the maximal permitted acceleration $V_s/L$. During the subsequent time $T_S$, the bending speed of the work piece 100 is maintained to the maximal permitted angular velocity $V_s/L$. After the time $T_S$ has passed, the bending speed of the work piece 100 is decreased with the fixed acceleration Ab during the time $T_D$. Then, at the time when this time $T_D$ is completed, the bending speed of the work piece 100 becomes 0. As described aboved, in this embodiment, the time from the start of bending to the end of bending of the work piece 100 is divided into three time regions, where the bending speed of the work piece 100 is controlled to be increased, maintained to the fixed speed and decreased.

Subsequently, the program proceeds to the step S603, where the top die *7b* is lowered to be in contact with the upper surface of the work piece 100. Then, the program proceeds to the step S604, in which it is determined whether the top die *7b* is in contact with the work piece 100.

Now, referring to FIG. 41, description will be made of a relation between the top die *7b*, the bottom die *7a* and the work piece 100 during the bending operation. The end of the top die *7b* is formed as a circular arc having a radius (ru). The bottom die *7a* has a side portion where a groove is formed and a top portion of the side portion to be in contact with the work piece 100 is formed in an articular arc having a radius (rd). The distance from the center of curvature of this top portion to the center of the groove is assumed to be (w). The plate thickness of the work piece 100 interposed between the bottom die *7a* and the top die *7b* is assumed to be (t). The distance or height between the center of curvature of the end of the top die *7b* and the center of curvature of the top portion of the bottom die *7a* is assumed to be (h). The data concerning this height (h) is obtained from the encoders 321*a* and 321*b* shown in FIG. 31. As the top die *7b* is lowered, that is, as the height (h) becomes smaller, the work piece 100 rises from the horizontal state. The rising angle (bending angle) is assumed to be ($\theta_n$) A line is drawn so as to pass through the center of curvature of the top portion of the bottom die *7a* and a contact point between this top portion and the work piece 100, and another line is drawn so as to pass through the center of curvature of the end of the top die *7b* and the center of the groove of the bottom die *7a*. Then, a point of intersection of these two lines is assumed to be O. The distance between this point O and the work piece 100 is assumed to be (R). In addition, the distance between the point O and the center of curvature of the end of the top die *7b* is assumed to be (P).

Now, referring again to FIG. 43A, in step S604, it is determined whether the top die *7b* is in contact with the work piece 100 and this determination can be made by the determination whether the relation $h \leqq (ru+t+rd)$ is established or not, as seen from FIG. 41. If the top die *7b* is not in contact with the work piece 100, that is, if h is larger than (ru+t+rd), the operation in the step S603 is performed again. On the other hand, if the top die *7b* is in contact with the work piece 100, that is, if h is smaller than (ru+t+rd), the program proceeds to the step S605 shown in FIG. 43B.

In the step S605, predetermined regions in the RAM 329 shown in FIG. 31 are initialized. More specifically, a region for storing a lapse of time from the start of bending of the work piece 100 (referred to hereinafter as a time region T) is set to 0, and a region for storing a distance between the bending center of the work piece 100 and the center of rotation of the gripper 27 (referred to hereinafter as a distance region Lm) is set to an initial value L (see the step S602). Then, the program proceeds to the step S606, where $\Delta T$ is added to the above described time region T. As will be made clear from the following description, an instructed position is renewed every $\Delta T$ seconds. Subsequently, the program proceeds to the step S607, where it is determined to what time region calculated in the previous step S602 the time data T stored in the time region T appertains. More specifically, if $T \leqq T_A$, it appertains to the acceleration region and then, the program proceeds to the step S608. If $T_A < T \leqq (T_A+T_S)$, it is determined that the time data T belongs to the fixed speed region and the program proceeds to the step S609. If $(T_A+T_S) < T \leqq (T_A+T_S+T_D)$, it is determined that the time data T belongs to the deceleration region and the program proceeds to the step S610. In these steps S608, S609 and S610, the angular velocity $\theta_n$ in the time T (which is the angular velocity of the angle $\theta_n$ shown in FIG. 41 and represents the bending speed of the work piece 100) and the angle $\dot{\theta}_n$ in the time T (see FIG. 41) are calculated respectively. At first, it is determined that T belongs to the acceleration region and the program proceeds to the step S608, where the angular velocity $\dot{\theta}_n$ and the angle $\theta_n$ in the time T are calculated by the following equations (26) and (27).

$$\dot{\theta}_n = (Aa/Lm)T \tag{26}$$

$$\theta_n = \tfrac{1}{2}(Aa/Lm)T^2 \tag{27}$$

When the acceleration region comes to an end and the fixed speed region sets in, the program proceeds to the step S309, where the angular velocity $\dot{\theta}_n$ and angle $\theta_n$ in the time T are calculated as follows.

$$\dot{\theta}_n = V_s/Lm \tag{28}$$

$$\theta_n = \tfrac{1}{2}(Aa/Lm)R_A^2 + (V_s/Lm)(T-T_A) \tag{29}$$

When the fixed speed region comes to an end and the deceleration region sets in, the program proceeds to the step S310, where the angular velocity $\dot{\theta}_n$ and angle $\theta_n$ in the time T are calculated by the following equations (30) and (31).

$$\dot{\theta}_n = (V_s/Lm) - (A_D/Lm)(T-T_A-T_S) \tag{30}$$

$$\theta_n = \tfrac{1}{2}(Aa/Lm)T_A^2 + (V_S/Lm)T_S + \tfrac{1}{2}(V_S/Lm)T_D - \tfrac{1}{2}\{(V_S/Lm)-(A_D/Lm)(T-T_A-T_S)\} \times (T_A+T_S+T_D-T) \tag{31}$$

Then, the operation in the step S611 shown in FIG. 43C is performed. In this step S611, an elongation $\Delta L$ of the work piece 100 in the bending angle $\theta_n$ calculated in any one of the above described steps S608, S609 and S610 is calculated. The elongation $\Delta L$ occurs due to the bending and has a correlation with the bending angle $\theta_n$. Accordingly, in this step S611, the elongation $\Delta L$ of the work piece 100 is calculated by the following equation (22).

$$\Delta L = f(\theta_n) \tag{32}$$

Subsequently, the program proceeds to the step S612, where the elongation $\Delta L$ of the work piece 100 is added to the distance data Lm stored in the above described distance region Lm of the RAM 329. As a result, the distance data Lm (that is, the distance between the bending center of the work piece 100 and the gripper 27) is corrected.

Then, the program proceeds to the step S613, where an instructed position H for the top die *7b* is calculated by the following equation (33).

$$H = h + \tau_P h \tag{33}$$

where h is an originally desired position of the top die *7b*, h is an element obtained by differentiating h by the time and represents a moving speed of the top die *7b* and $\tau_P$ represents a time constant of the bending machine 321 with respect to the position instruction. In addition, the term of $\tau_P h$ represents an element for correction applied for correcting the delay of response in the bending machine 321. In other words, in this embodiment, correction of delay of response is made by regarding the bending machine 321 as a system having a first order lag. The value h in the equation (33) is obtained by the following equation (34).

$$h = \frac{t + rd + ru}{\cos\theta_n} - w \tan\theta_n \quad (34)$$

This equation (34) can be established easily from the following equations (35) and (36).

$$P \cos \theta = R - ru \quad (35)$$

$$(P+h) \cos \theta = R + t + rd - w \sin \theta \quad (36)$$

The value h in the equation (33) is obtained from the following equation (37).

$$\dot{h} = \left\{ \frac{t + ru + rd}{\cos\theta_n} \cdot \tan \theta - \frac{w}{\cos^2\theta_n} \right\} \dot{\theta}_n \quad (37)$$

Subsequently, in the step S614, an instructed position of the moving mechanism 300 is calculated. Calculation of the instructed position in this step is also made by taking account of delay of response in the moving mechanism 300, as in the calculation of the instructed position in the previous step S613. In this step, first, an element for correction is added to $\theta_n$, which is an originally desired bending angle of the work piece 100. More specifically, a bending angle $\theta_P$ to which the element for correction is added is calculated by the following equation (38).

$$\theta_P = \theta_n + \tau_R \cdot \theta_n \quad (38)$$

where $\tau_R$ is a time constant of the moving mechanism 300 with respect to the position instruction and the term of $\tau_R \cdot \dot{\theta}_n$ represents an element for correction. Accordingly, in this step S614, the element for correction is established by regarding the moving mechanism 300 as a system having a first order lag. Subsequently, instructed positions $X_P$, $Z_P$ and $\alpha_P$ for the respective control axes of the moving mechanism 300 are calculated using the bending angle $\theta_P$ obtained by the equation (38). FIG. 42 shows a model for calculating an instructed position of each control axis at this time. According to this model, the instructed positions $X_P$, $Z_P$ and $\alpha_P$ of the control axes are calculated respectively by the following equations (39), (40) and (41).

$$X_P = X_O - Lm \cos \theta_P \quad (39)$$

$$Z_P = Z_O + Lm \sin \theta_P - h \quad (40)$$

$$\alpha_P = \theta_P \quad (41)$$

Subsequently, the program proceeds to the step S615, where it is determined whether $\Delta T$ seconds have passed from the time setting in the previous step S606. This determination is repeatedly made until $\Delta T$ seconds have passed. When $\Delta T$ seconds have passed, the program proceeds to the step S616, where instruction of the position obtained in the previous step S613 is given to the bending machine 321 and instruction of the position obtained in the previous step S614 is given to the moving mechanism 300. According to these position instructions, the bending machine 321 and the moving mechanism 300 operate to position the respective control axes. Since delay of response occurs in the control axes, a precise follow-up cannot directly be made even if the position instructions are given. However, the delay of response in the control axes is corrected since the instructed positions are calculated by taking account of an element for correction in the steps S613 and S614. Accordingly, the respective control axes can be moved smoothly.

Subsequently, the program proceeds to the step S617, where it is determined whether the deceleration region comes to an end or not. In other words, it is determined whether the condition $T \geqq (T_A + T_S + T_O)$ is satisfied or not. If it is determined that the deceleration region does not come to an end, the operations in the step S606 and the subsequent steps described above are performed again. On the other hand, if it is determined that the decelaration region comes to an end, it means that the bending of the work piece 100 is completed and accordingly, the program proceeds to the step S618, where the top die 7b is lifted. Thus, the first bending operation of the work piece 100 is completed.

As described above, according to the above stated embodiment, the positions to be instructed are calculated by taking account of the time constants and moving speed in the respective control axes of the bending machine 321 and the moving mechanism 300, so that the delay of response in the control axes can be corrected. Accordingly, the control axes move smoothly, which can prevent deformation of the work piece or the apparatus.

Although in the above described embodiment, the work piece 100 is bent by lowering the top die 7b, the work piece 100 may be bent by lifting the bottom die 7a, conversely.

Although in the above described embodiment, delay of response of both bending machine 321 and moving mechanism 300 is corrected, only delay of response of the moving mechanism 300 may be corrected.

Embodiment in which removal of a work piece is improved

In all the above described embodiments, a moving mechanism is provided and by this moving mechanism, a work piece or plate is automatically positioned with respect to a bending machine so that predetermined points are successively bent. When such a bending process is completed, the moving mechanism removes the work piece from the position between the top die and the bottom die. However, if removal of a work piece is made by displacing it on the straight irrespectively of the shape thereof, it sometimes occurs that the work piece interferes with the bending machine, causing deformation of the work piece or damage to the bending machine.

Therefore, in the following, an embodiment in which a work piece can be removed from the position between the top die and the bottom die without interference with the press brake type bending machine.

Briefly stated, according to this embodiment, position data of each bending point in a plate and position data of a predetermined point having a predetermined relation with the corresponding bending point are calculated and stored in a memory each time a plate is bent, and at the time of removing the plate, the moving mechanism is controlled to make the respective predetermined points as described above successively pass through a reference point determined in advance, whereby the plate is removed from between the top die and the bottom die.

In the following, this embodiment will be described in detail.

FIG. 44 illustrates a P-Q table stored in a predetermined area in the RAM 329 shown in FIG. 31. This P-Q table is provided with areas for storing predetermined data for each of the bending points $P_1$, $P_2$, . . . $P_e$. In each area, a flag, position data of a predetermined point Q, position data of a bending point P are stored. The above described flag serves to indicate whether the bending point is an end point or not and whether the bending point is already subjected to the bending operation or not. The predetermined point Q serves as a mark for movement at the time of removing the work piece 100 from the press brake type bending machine 321.

Figure 45:
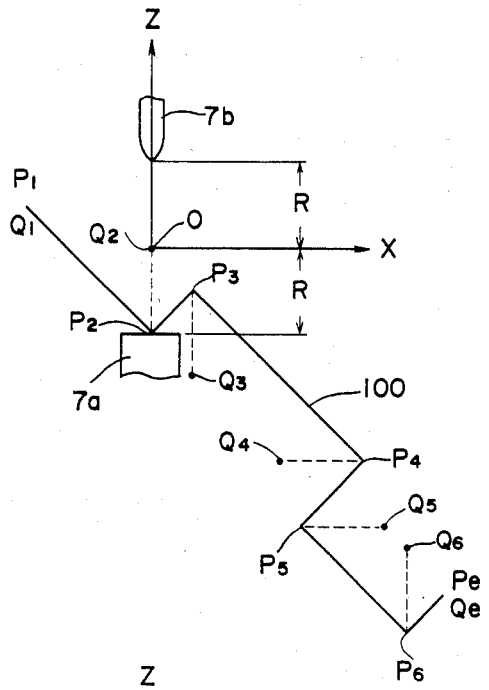
FIG. 45 is a view for explaining the operational principle of still a further embodiment of the present invention.
Figure 46:
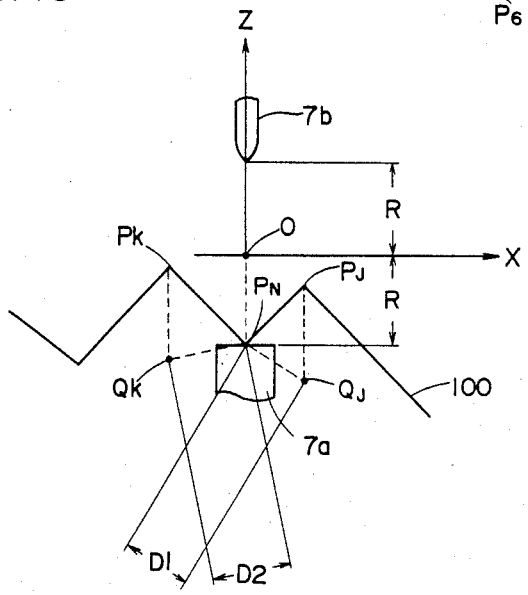
FIGS. 46 to 49 are views for facilitating the understanding of the operation in still a further embodiment of the present invention.
Figure 47:
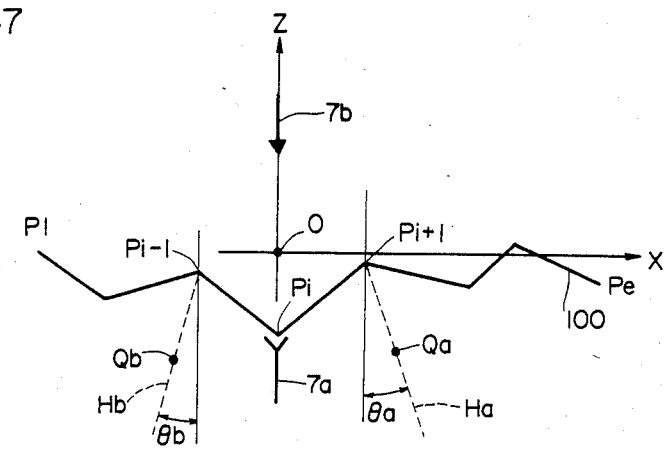
Figure 48:
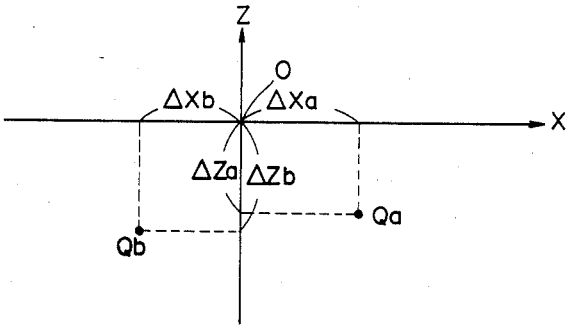

FIG. 45 is a view for explaining the operational principle of this embodiment. First, referring to FIG. 45, the operational principle of this embodiment will be described. In the work piece 100, bending points $P_1$ to $P_e$ are determined in advance. The work piece is positioned so that the bending points are positioned between the bottom die *7a* and the top die *7b*, and then the bending operation is made. At this time, position data of each bending point P and position data of a predetermined point Q related to the bending point concerned are obtained. FIG. 45 shows a state where a bending point $P_2$ is subjected to the bending operation and after that the top die *7b* is returned to the initial position. In this state, a point positioned on the origin O in the X-Z axes coordinate system is obtained as a predetermined point $Q_2$ related to the bending point $P_2$. In the same manner, with respect to other bending points $P_3$ to $P_6$, predetermined points $Q_3$ to $Q_6$ are obtained. More specifically, assuming that the distance between the top die *7b* and the bottom die *7a* in case where the top die *7b* is returned to the initial position is 2R, a predetermined point related to a bending point exists on a line dividing into two equal amounts the bending angle at the bending point concerned and is distant from the bending point by R. Since both end points $P_1$ and $P_e$ of the work piece 100 are not subjected to the bending operation, the predetermined points $Q_1$ and $Q_e$ are selected to be in the same positions as the bending points $P_1$ and $P_e$. The position data of the predetermined points Q obtained as described above are stored, together with the position data of the bending points P, in the RAM 329.

In order to remove the work piece 100 from between the top die *7b* and the bottom die *7a*, first, the work piece 100 is moved so that a predetermined point Q is positioned at the origin O in the X-Z axes coordinate system. At the same time, the posture of the work piece 100 is controlled so that a bending point P corresponding to the predetermined point Q is positioned on the Z axis. This operation is made successively for each predetermined point Q, whereby the work piece 100 is gradually removed.

Figure 49:
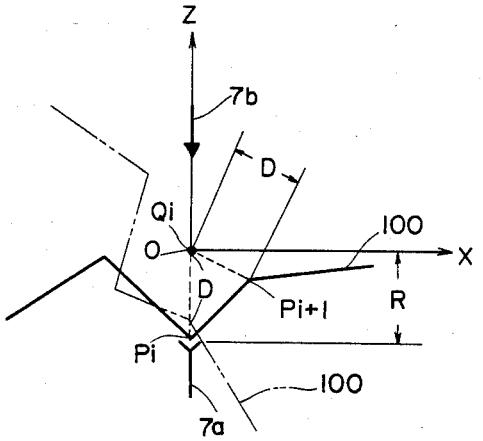
Figure 50A:
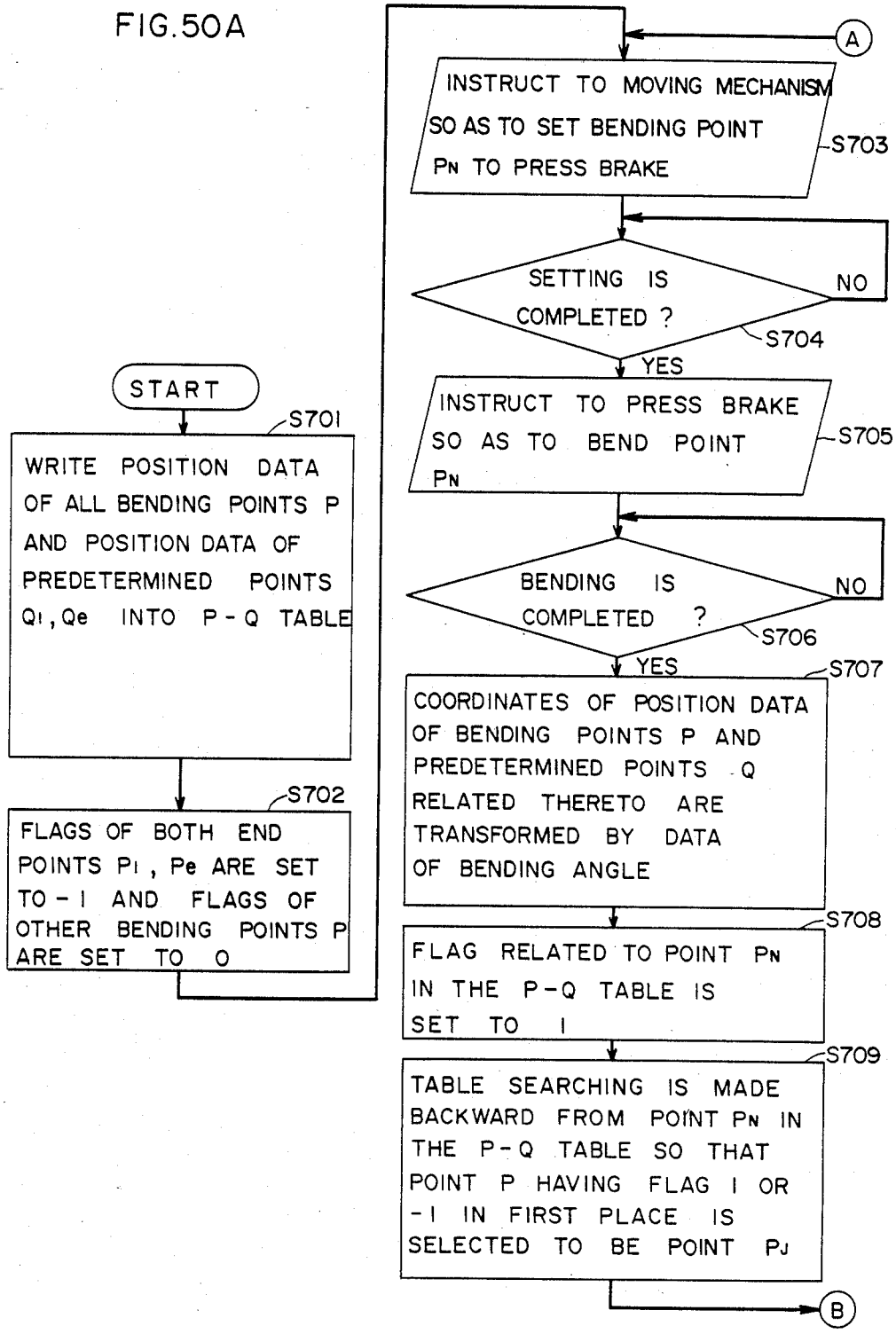
FIGS. 50A, 50B, 51A and 51B are flow charts for explaining the operation of the CPU shown in FIG. 31.
Figure 50B:
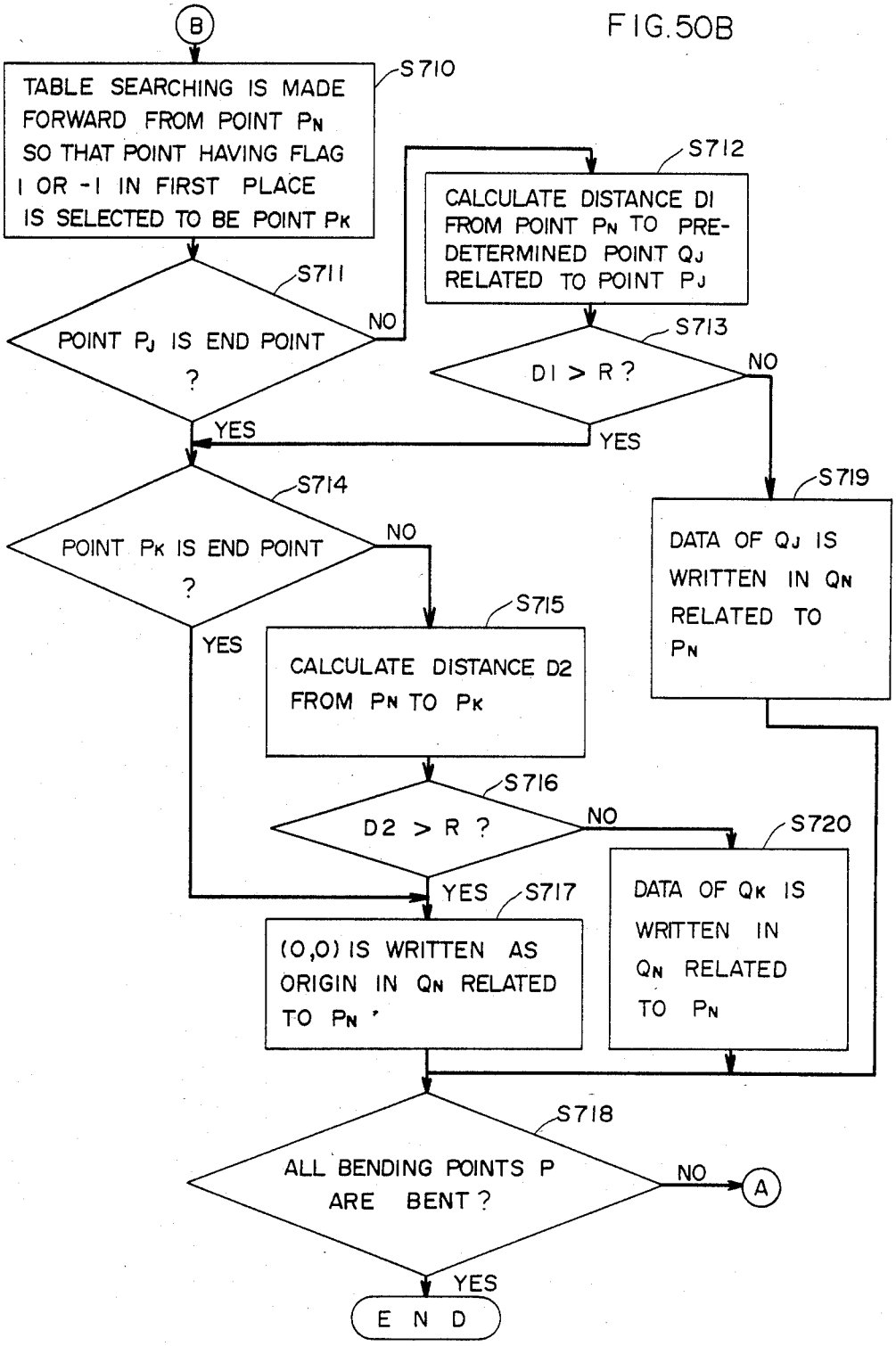
Figure 51A:
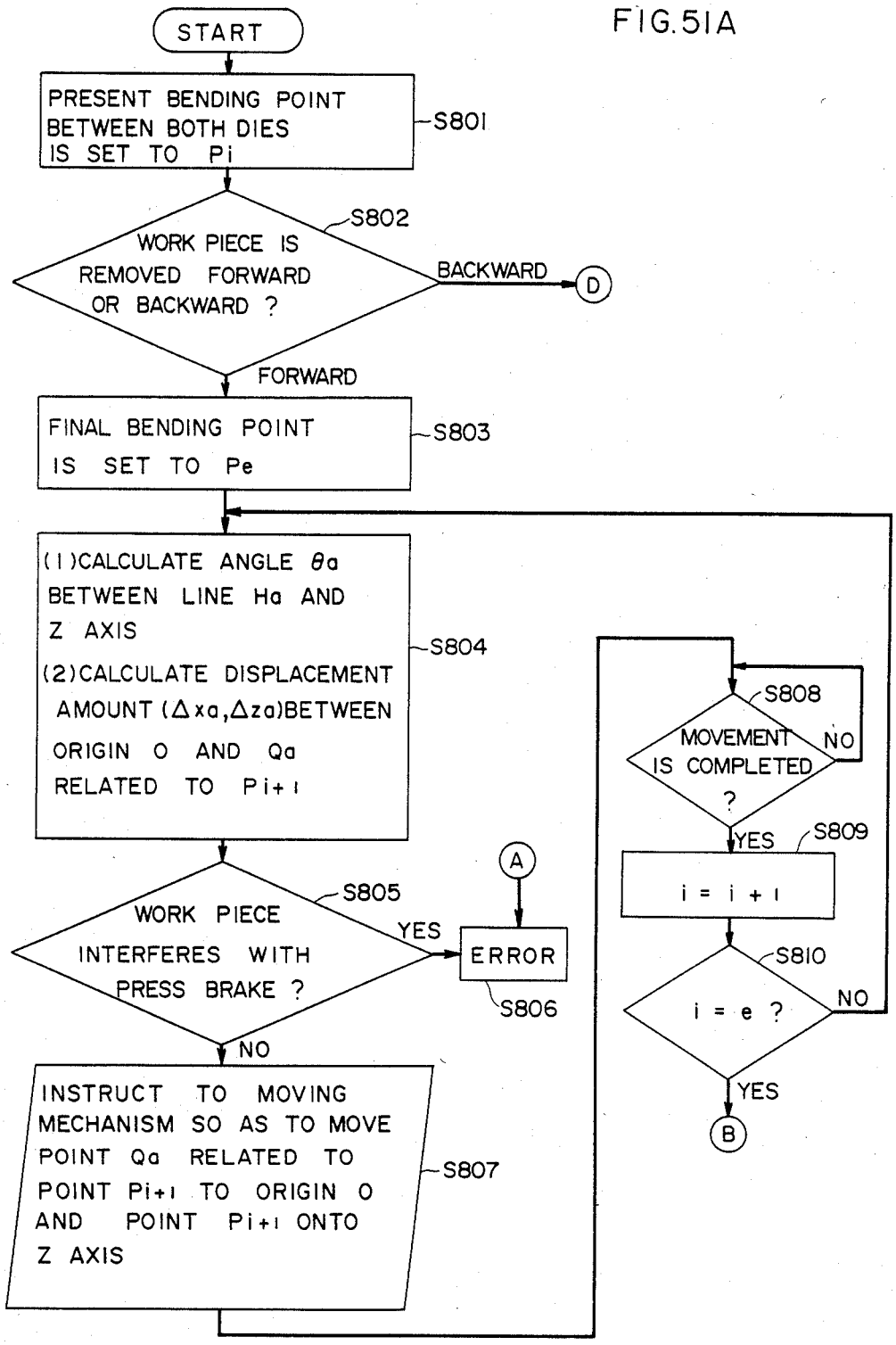
Figure 51B:
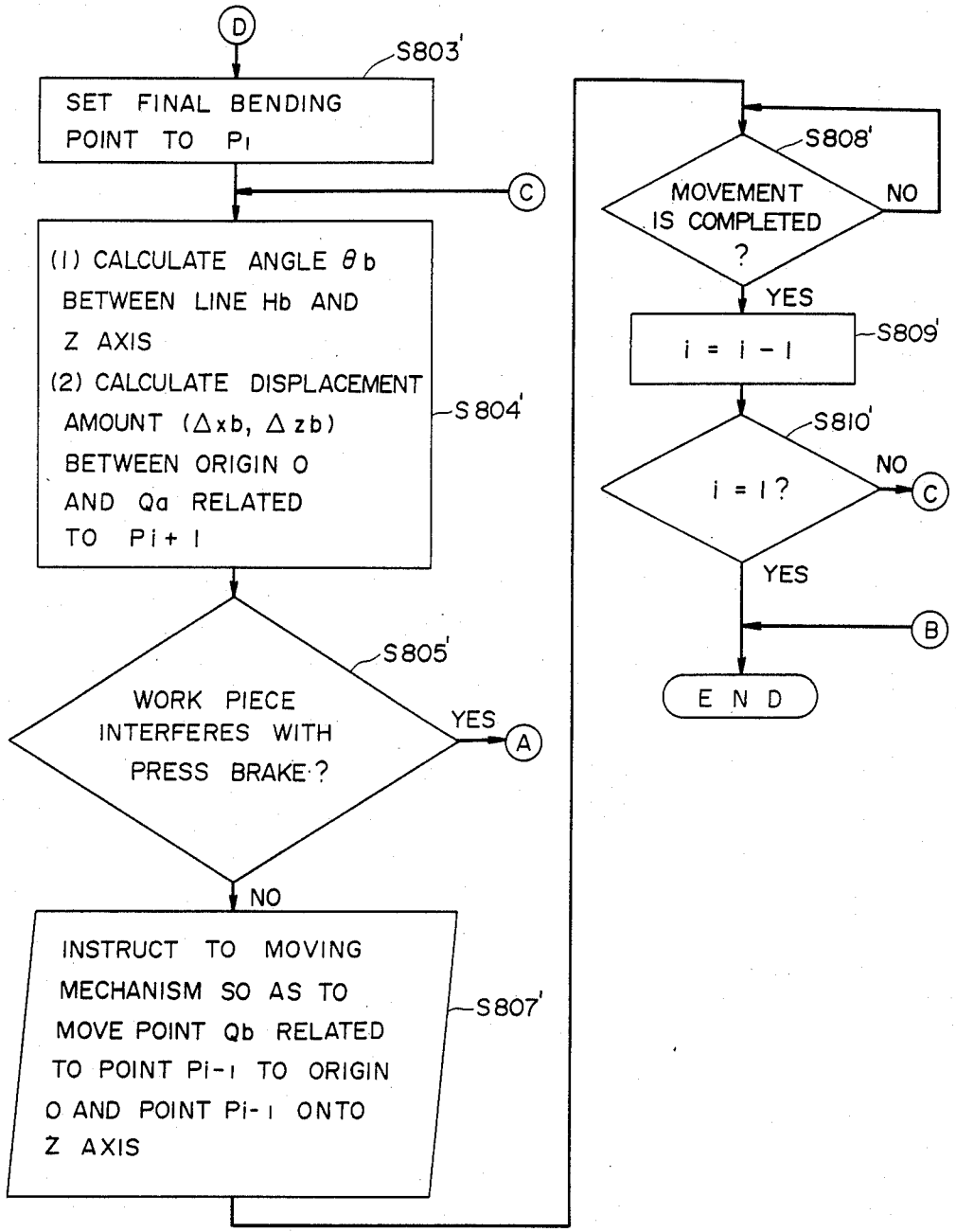

FIGS. 46 to 49 are views for facilitating the understanding of the operation in this embodiment. FIGS. 50A, 50B, 51A and 51B are flow charts for explaining the operation of the CPU 326 shown in FIG. 31. In particular, FIGS. 50A and 50B show the bending operation of the work piece 100 and the calculating operation at each predetermined point Q and FIGS. 51A and 51B show the removing operation of the work piece 100. In the following, the operation in this embodiment will be made with reference to FIGS. 46 to 51.

First, referring to FIGS. 50A and 50B, description will be made of the bending operation of the work piece and the calculating operation of the predetermined point Q. In the first step S701 shown in FIGS. 50A and 50B, the position data of the all the bending points P including both end points of the work piece 100 and the position data of the predetermined points $Q_1$ and $Q_e$ corresponding to both end points $P_1$ and $P_e$ are written in the P-Q table shown in FIG. 44. Then, in the step S702, the flags of both end points $P_1$ and $P_e$ in the P-Q table are set to −1 and the flags of the other bending points are set to 0. Subsequently, in the step S703, instructions are provided to the oil hydraulic circuits of the respective axes of the moving mechanism 300 so that a bending point $P_N$ to be subjected to the bending operation hereinafter is set to the press brake type bending machine 321. Subsequently, in the step S704, it is determined whether the above described setting of the bending point $P_N$ is completed or not. If it is determined that the setting is completed, the program proceeds to the step S705, where the press brake type bending machine 321 is instructed to make the bending operation. Consequently, the press brake type bending machine 321 operates to lower the top die *7b* and the bending point $P_N$ set in the above described step S703 is bent. At the time of this bending operation, the gripper 27 continuously holds both ends of the work piece 100, as described above, and accordingly, the positioning of the gripper 27 is controlled to follow up the rising of the work piece 100. In the step S706, it is determined whether the bending of the work piece 100 is completed or not. If it is determined that the bending is completed, the program proceeds to the step S707, where coordinate transformation of the position data of the respective bending points P and the predetermined points Q related thereto in the P-Q table is performed based on the data of the bending angle. More specifically, the position data of the bending points P and the predetermined points Q written in the P-Q table at the time of the previous bending operation are rewritten into the present position data. After that, the program proceeds to the step S708, where a flag corresponding to the bending point $P_N$ in the P-Q table is set to 1. Thus, the completion of the bending at the bending point $P_N$ is stored in the RAM 329.

Then, the program proceeds to the step S709, where table searching is made backward in the P-Q table (see FIG. 44), so that a bending point having a flag of 1 or −1 in the first place is selected to be a bending point $P_J$. In the step S710, table searching is made forward in the P-Q table with respect to the bending point $P_N$, so that a bending point having a flag of 1 or −1 in the first place is selected to be a bending point $P_K$. In the above described steps S709 and S710, among the bending points at which the bending is already made, a bending point in the backward direction, closest to the bending point $P_N$ subjected to this bending operation, is selected to be $P_J$ and a bending point closest thereto in the forward direction is selected to be $P_K$. If a bending point immediately adjacent to the bending point $P_N$ is an end point $P_1$ or $P_e$, the end point is made to be the bending point $P_J$ or $P_K$. Subsequently, in the step S711, it is determined whether the flag corresponding to the bending point $P_J$ is −1 or not, that is, whether the bending point $P_J$ is an end point or not. If the bending point is an end point, the operation in the step S714 to be described below is performed. If the bending point $P_J$ is not an end point, the program proceeds to the step S712, where a distance D1 from the bending point $P_N$ to the predetermined point $Q_J$ related to the bending point $P_J$ (see FIG. 46) is calculated. Then, in the step S713, it is determined whether the distance D1 is larger than R (the distance from the bottom die 7a to the origin O in the X-Z axes coordinate system). If the distance D1 is larger than R, the program proceeds to the step S714, where it is determined whether the flag of the bending point $P_K$ is $-1$ or not, that is, whether the bending point $P_K$ is an end point of the work piece or not. If the bending point $P_K$ is an end point, the operation in the step S717 to be described below is performed. If the bending point $P_K$ is not an end point, the program proceeds to the step S715, where a distance D2 from the bending point $P_N$ to the predetermined point $Q_K$ related to the bending point $P_K$ (see FIG. 46) is calculated. Then, in the step S716, it is determined whether the distance D2 is larger than the above described distance R or not. If the distance D2 is larger than R, the program proceeds to the step S717, where the coordinates (0, 0) of the origin O are written in the P-Q table as the predetermined points $Q_N$ related to the bending point $P_N$. Subsequently, the program proceeds to the step S718, where it is determined whether all the bending points are subjected to the bending operation, that is, whether any flag 0 is contained in the P-Q table. If there remain bending points not yet subjected to the bending operation, the operations in the step S703 and the subsequent steps are made again. On the other hand, if the bending at all the bending points P is completed, the sequence of operations in FIGS. 50A and 50B is brought to an end.

In the following, description will be made of a case where it is determined that the distance D1 is smaller than R in the above described step S713. In this case, the program proceeds to the step S719, where the position data of the predetermined point $Q_J$ related to the bending point $P_J$ is written in the P-Q table as the predetermined point $Q_N$ corresponding to the bending point $P_N$. More specifically, if the distance D1 is smaller than R, the predetermined point $Q_J$ related to the bending point $P_J$ is used as the predetermined point related to the bending point $P_N$. This is made for the purpose of facilitating the calculation at the time of removing the work piece 100, which will be described below.

On the other hand, in case where it is determined that the distance D2 is larger than R in the above described step S716, the program proceeds to the step S720, where the position data of the predetermined point $Q_K$ related to the bending point $P_K$ is written in the P-Q table as the predetermined point $Q_N$ related to the bending point $P_N$. This writing is also made for the purpose of facilitating the calculation at the time of removal of the work piece 100, as in the above described case.

Now, referring to FIGS. 51A and 51B, removing operation of the work piece 100 will be described. First, in the step S801, a bending point positioned at present between the bottom die 7a and the top die 7b is assumed to be $P_i$ (see FIG. 47). Then, in the step S802, it is determined in which direction, forward or backward, the work piece 100 is removed from the press brake type bending machine 321. If the work piece 100 is to be removed forward from the press brake type bending machine 321, the program proceeds to the step S803, where the final bending point is set to $P_e$. Then, in the step S804, an angle $\theta a$ formed by a line Ha passing through a bending point $P_{i+1}$ and a predetermined point $Q_a$ related thereto will respect to the Z axis (see FIG. 47) is calculated. In addition, displacement amounts $\Delta Xa$ and $\Delta Za$ between the origin O and the predetermined point $Q_a$ (see FIG. 48) are calculated. Based on the data obtained in this step S804, the work piece 100 is made to move. Before moving the work piece actually, it is determined in the step S805 whether the work piece 100 does not interfere with the press brake type bending machine 321 at the time of movement. If the work piece 100 moves to interfere with the press brake type bending machine 321, error processing is made in the step S806. On the other hand, if it is determined that the work piece moves not to interfere with the press brake type bending machine 321, the program proceeds to the step S807, where the oil hydraulic circuits of the respective control axes of the moving mechanism 300 for the work piece 100 are controlled so that the predetermined point $Q_a$ is moved to the origin O and the bending point $P_{i+1}$ is moved onto the Z axis. Subsequently, in the step S808, it is determined whether the movement of the work piece 100 is completed or not. If it is determined that the movement is completed, the program proceeds to the step S809, where the number i of the bending point is renewed (+1). Then, in the step S810, it is determined whether the number i is e or not, that is, whether the bending point positioned at present between the bottom die 7a and the top die 7b is the end point $P_e$ or not. If the bending point between both dies is not $P_e$, it means that the removal is not completed, and therefore, the operations in the step S804 and the subsequent steps are performed again. On the other hand, if the bending point between the top and bottom dies is the end point $P_e$, the removal of the work piece is completed and therefore, the sequence of operations in FIGS. 51A and 51B is brought to an end.

Thus, the case in which the work piece 100 is removed forward from the press brake type bending machine 321 was described above. On the other hand, the case in which the work piece 100 is removed backward therefrom will be described in the following. In the above described step S802, if it is determined that the work piece 100 is to be removed backward from the press brake type bending machine 321, the program proceeds to the step S803', where the end point $P_1$ of the work piece 100 is set as the final bending point. Then, in the step S804', an angle $\theta b$ formed by a line Hb passing through a bending point $P_{i-1}$ and a predetermined point $Q_b$ related thereto with respect to the Z axis (see FIG. 47) is calculated and displacement amounts $\Delta Xb$ and $\Delta Zb$ between the origin and the predetermined point $Q_b$ (see FIG. 48) are calculated. Subsequently, in the step S805', the same operation as in the above described step S805 is performed. Specifically stated, for moving the work piece 100 based on the data calculated in the step S804', it is determined whether the work piece 100 does not interfere with the press brake type bending machine 321. If it is determined that the work piece 100 interferes with the press brake type bending machine 321, error processing is made in the above described step S806. If it is determined that interference is not caused, the program proceeds to the step S807', where the work piece 100 is moved so as to position the predetermined point $Q_b$ to the origin O and the bending point $P_{i-1}$ onto the Z axis. Then, in the step S808', it is determined whether the movement is completed or not. If the movement is completed, the number i of the bending point is renewed in the step S809'. This renewal of the number i is made so as to change the number i by $-1$, contrary to the above described step S809. Then, in the step S810', it is determined whether the number i is 1 or not, that is, whether the bending point $P_i$ positioned at present between the bottom die 7a and the top die 7b is the end point $P_1$ of the work piece 100 or not. If it is not the end point $P_1$, the operations in the step S804' and the subsequent steps are made again. If the point $P_i$ is the end point $P_1$, it means that the removal of the work piece 100 is completed, and therefore, the sequence of operations in FIGS. 51A and 51B is brought to an end.

As described in conjunction with FIGS. 50A and 50B, there is a case in which as a predetermined point related to a certain bending point, a predetermined point related to a bending point adjacent to the above stated bending point is used. More specifically, there is a case in which the distance (D1, D2) between a certain bending point and a predetermined point related to a bending point adjacent to the above stated bending point is smaller than the above described distance R (the distance from the origin O to the bottom die *7a* or the top die *7b*). Movement of the work piece 100 in this case will be described referring to FIG. 49. In FIG. 49, as a predetermined point related to a bending point $P_{i+1}$, a predetermined point $Q_i$ is used since the distance D between a predetermined point $Q_i$ related to a bending point $P_i$ and a bending point $P_{i+1}$ is smaller than the above described distance R. Now, let us assume a state in which the predetermined point $Q_i$ is positioned to the origin O and the bending point $P_i$ is positioned on the Z axis. From this state, a predetermined point related to the bending point $P_{i+1}$ is to be moved to the origin O and the bending point $P_{i+1}$ is to be moved onto the Z axis. However, since the predetermined point $Q_i$ is used as the predetermined point related to the bending point $P_{i+1}$, it is only necessary to move the bending point $P_{i+1}$ onto the Z axis. In other words, the work piece 100 has only to be rotated by a predetermined angle with the origin O as a center. As a result, calculation for movement of the work piece 100 can be made simple. In addition, calculation for obtaining new position data concerning the bending points and the predetermined points after movement of the work piece 100 can be simplified. The posture of the work piece 100 after movement is shown by the chained line in FIG. 49. As is clear from FIG. 49, the distance D between the origin O and the bending point $P_{i+1}$ is smaller than the distance R between the origin O and the bottom die *7a* and accordingly, the work piece 100 will never interfere with the bottom die *7a*. For this reason, the predetermined points can be used commonly. The work piece 100 may be rotated in the direction opposite to that described above. However, it can be easily understood that in this case also, the work piece 100 will never interfere with the top die *7b*.

In the above described embodiment, the distance between the bending point P and a predetermined point Q related thereto is selected to be R. However, by selecting the distance in such a manner, it might happen that the bending points P pass in the immediate vicinity of the bottom die *7a* or the top die *7b* at the time of removing the work piece 100, and in such a case, the work piece 100 might touch the bottom die *7a* or the top die *7b* due to mechanical vibration or flection of the work piece and the like. For these reasons, it is preferred that the distance between a bending point P and a predetermined point Q related thereto is selected to be a little smaller than the distance R.

In the foregoing embodiment, the case where the work piece is removed was described. However, needless to say, this embodiment can be applied also to a case in which a work piece already bent is inserted between the top die *7b* and the bottom die *7a*. In this case, the work piece needs only to be moved in the order contrary to that described above.

As described above, according to this embodiment, position data of the predetermined points respectively having predetermined relation with the bending points are calculated at the time of bending the work piece, so that at the time of removal of the work piece, the work piece is moved so as to make the above described predetermined points pass through a reference point. As a result, the work piece can be removed automatically without interfering with the bending machine.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An automatic bending apparatus comprising:

a bending machine including a bottom die and a top die for bending a plate interposed therebetween into a desired form, means for moving said bottom die and top die towards each other to effect said bending, gripper means disposed at least in front of said bending machine for holding a portion of said plate, said plate portion being held in a first position before bending, and in a follow-up position after bending, said plate portion being held continuously during loading, bending, and unloading from said bending machine, means for movably mounting said gripper means on said bending machine so that said gripper means is variably positionable in a vertical plane in the forward and backward direction of said bending machine as well as around a horizontal axis orthogonally intersecting with said vertical plane, calculating means for calculating said follow-up position of said gripper means according to the displacement of said plate, and means for controlling the position of said gripper means during bending of said plate, said controlling means being responsive to said calculating means.

2. An automatic bending apparatus in accordance with claim 1, wherein said top die is mounted on said bending machine so as to be vertically movable with respect to said bending machine.

3. An automatic bending apparatus in accordance with claim 2, said automatic bending apparatus further comprising means for providing data concerning the position of said top die, said calculating means comprising:

angle calculating means for calculating a displacement angle of said plate from said data concerning the position of said top die, and means for calculating necessary control elements from said displacement angle calculated by said angle calculating means.

4. An automatic bending apparatus in accordance with claim 1, wherein said bottom die is mounted on said bending machine so as to be vertically movable with respect to said bending machine.

5. An automatic bending apparatus in accordance with claim 4, said automatic bending apparatus further comprising means for providing data concerning the position of said bottom die, said calculating means comprising:

angle calculating means for calculating a displacement angle of said plate from said data concerning the position of said bottom die, and means for calculating necessary control elements from said displacement angle calculated by said angle calculating means.

6. An automatic bending apparatus comprising:

a bending machine including a top die and a bottom die for bending a plate interposed therebetween into a desired form, said bending machine also including means for moving said top and bottom dies to predetermined positions to effect said bending, said bending machine controlling said position of at least one of said top die and said bottom die in response to a first position instruction given thereto, first calculating means for calculating successively data concerning the position of at least one of said top die and said bottom die so as to supply the result of calculation to said bending machine as said first position instruction, a gripper disposed at least in front of said bending machine so as to hold a portion of said plate, said plate portion being held in a first position before bending, and in a follow-up positon after bending, said plate portion being held continuously during loading, bending and unloading from said bending machine, means for movably mounting said gripper on said apparatus so that said gripper is variably positionable in a vertical plane in the forward and backward direction of said bending machine as well as around a horizontal axis orthogonally intersecting with said vertical plane, gripper positioning control means for controlling positioning of said gripper during bending of said plate in response to a second position instruction given thereto, and said calculating means for calculating successively said follow-up position of said gripper according to the displacement of said plate caused by bending of said plate so as to supply the result of calculation to said gripper positioning control means as said second position instruction, said second calculating means comprising:

means for calculating an initially desired position of said gripper, means for calculating an element of correction of a delay of response in said gripper positioning control means with respect to said second position instruction, said means being responsive to velocity of said gripper when said gripper moves from said first position to said follow-up position, means for establishing said second instruction to be given to said gripper positioning control means, based on said initially desired position and said element for correction.

7. An automatic bending apparatus in accordance with claim 6, said first calculating means comprising:

means for calculating an initially desired position of at least one of said top die and said bottom die, means for calculating an element for correction of a delay of response in said bending machine with respect to said first position instruction, said means being responsive to a relative velocity of one of said dies with respect to said other die when said gripper moves from said first position to said follow-up position, and means for establishing said first position instruction to be given to said bending machine, based on said initially desired position and said element for correction.

8. An automatic bending apparatus in accordance with claim 7, said automatic bending apparatus further comprising means for calculating, based on a final bending angle of said plate, a time region for bending said plate by applying predetermined acceleration, a time region for bending said plate with a fixed velocity and a time region for bending said plate by applying predetermined deceleration, said first calculating means calculating said first position instruction by changing a velocity element according to each of said calculated time regions, and said second calculating means calculating said second position instruction by changing a velocity element according to each of said calculated time regions.

9. An automatic bending apparatus for bending a plate comprising:

a top die and a bottom die;

means for movably connecting said top and bottom dies to said apparatus;

means connected to said apparatus for gripping and positioning said plate between said top die and said bottom die;

means connected to at least one of said top and bottom dies for moving said top and bottom dies together to bend said plate therebetween;

position data calculating means for calculating position data of each bending point in said plate and position data of corresponding predetermined points each at a predetermined angularly displaced location with respect to each bending point as said plate is bent, storage means responsive to said position data calculating means for storing said position data, and plate removing control means responsive to said storage means for controlling said gripping and positioning means, based on said position data stored in said storage means so as to make said each predetermined point successively pass through a predetermined coordinate reference point with respect to said top and bottom dies, whereby said plate is removed from between said top die and said bottom die without interfering with said dies.

10. An automatic bending apparatus in accordance with claim 9, wherein said predetermined point is a point existing on a line dividing into two equals amounts the opening angle of said plate in said each bending point.

11. An automatic bending apparatus in accordance with claim 10, wherein said predetermined point is selected to be a point at a shorter distance than R from the corresponding bending point, R being half the distance between said top die and said bottom die at the time of removing said plate therefrom, and said reference point is selected to be a point dividing into two equal amounts a line segment joining said top die and said bottom die.

12. An automatic bending apparatus in accordance with claim 11, wherein said position data calculating means adopts as said predetermined point corresponding to a specified bending point, a predetermined point corresponding to a bending point adjacent to said specified bending point if a distance between said specified bending point and said predetermined point corresponding to said adjacent bending point is smaller than said R.

13. An automatic bending apparatus in accordance with claim 12, wherein said plate removing control means controls posture of said plate using said moving means so that when said predetermined point is positioned at said reference point, a bending point corresponding thereto is positioned on said line segment joining said top die and said bottom die.

* * * * *